US008888933B2

(12) United States Patent
Hayashi et al.

(10) Patent No.: US 8,888,933 B2
(45) Date of Patent: Nov. 18, 2014

(54) HIGH-STRENGTH STEEL SHEET, HOT-DIPPED STEEL SHEET, AND ALLOY HOT-DIPPED STEEL SHEET THAT HAVE EXCELLENT FATIGUE, ELONGATION, AND COLLISION CHARACTERISTICS, AND MANUFACTURING METHOD FOR SAID STEEL SHEETS

(75) Inventors: Kunio Hayashi, Tokyo (JP); Toshimasa Tomokiyo, Tokyo (JP); Nobuhiro Fujita, Tokyo (JP); Naoki Matsutani, Tokyo (JP); Koichi Goto, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 455 days.

(21) Appl. No.: 13/138,898

(22) PCT Filed: May 26, 2010

(86) PCT No.: PCT/JP2010/003541

§ 371 (c)(1),
(2), (4) Date: Oct. 19, 2011

(87) PCT Pub. No.: WO2010/137317

PCT Pub. Date: Dec. 2, 2010

(65) Prior Publication Data

US 2012/0031528 A1 Feb. 9, 2012

(30) Foreign Application Priority Data

May 27, 2009 (JP) ..... 2009-127340

(51) Int. Cl.
*C22C 38/02* (2006.01)
*C22C 38/04* (2006.01)

(Continued)

(52) U.S. Cl.
CPC ..... *C21D 9/46* (2013.01); *C22C 38/001* (2013.01); *C21D 2211/008* (2013.01);

(Continued)

(58) Field of Classification Search
None
See application file for complete search history.

(56) References Cited

U.S. PATENT DOCUMENTS

| | | | | |
|---|---|---|---|---|
| 2003/0111144 | A1 | 6/2003 | Matsuoka et al. | |
| 2007/0119521 | A1 * | 5/2007 | Yokota et al. | 148/337 |
| 2009/0098408 | A1 * | 4/2009 | Sun | 428/684 |

FOREIGN PATENT DOCUMENTS

| | | |
|---|---|---|
| EP | 1375681 | 1/2004 |
| EP | 1616970 | 1/2006 |

(Continued)

OTHER PUBLICATIONS

Canadian Office Action, dated Aug. 7, 2012, issued in corresponding Canadian application No. 2759256.

(Continued)

*Primary Examiner* — Deborah Yee
(74) *Attorney, Agent, or Firm* — Kenyon & Kenyon LLP

(57) ABSTRACT

This high-strength steel sheet includes: in terms of percent by mass, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.15% of Ti; and 0.01% or less of N; and contains as the balance, iron and inevitable impurities, wherein a tensile strength is in a range of 590 MPa or more, and a ratio between the tensile strength and a yield strength is in a range of 0.80 or more, a microstructure includes bainite at an area ratio of 40% or more and the balance being either one or both of ferrite and martensite, a density of Ti(C,N) precipitates having sizes of 10 nm or smaller is in a range of $10^{10}$ precipitates/$mm^3$ or more, and a ratio (Hvs/Hvc) of a hardness (Hvs) at a depth of 20 μm from a surface to a hardness (Hvc) at a center of a sheet thickness is in a range of 0.85 or more.

14 Claims, 8 Drawing Sheets

(51) Int. Cl.

| | |
|---|---|
| ***C22C 38/14*** | (2006.01) |
| ***C22C 38/06*** | (2006.01) |
| ***C21D 8/02*** | (2006.01) |
| ***C23C 2/06*** | (2006.01) |
| ***C21D 9/46*** | (2006.01) |
| ***C22C 38/00*** | (2006.01) |
| ***C23C 2/28*** | (2006.01) |
| ***C23C 2/02*** | (2006.01) |
| ***C22C 38/12*** | (2006.01) |

(52) U.S. Cl.

CPC ..... *C21D 2211/005* (2013.01); *C22C 38/06* (2013.01); *C21D 2211/004* (2013.01); *C21D 8/0205* (2013.01); *C21D 2211/002* (2013.01); *C23C 2/28* (2013.01); *C22C 38/02* (2013.01); *C22C 38/14* (2013.01); *C23C 2/02* (2013.01); *C23C 2/06* (2013.01); *C21D 8/0221* (2013.01); *C22C 38/04* (2013.01); *C22C 38/12* (2013.01)

USPC ..... 148/328; 148/330; 148/533; 148/602; 428/659

(56) References Cited

FOREIGN PATENT DOCUMENTS

| | | |
|---|---|---|
| EP | 1865083 | 12/2007 |
| JP | 04-314828 | 11/1992 |
| JP | 05-117834 | 5/1993 |
| JP | 06-035647 | 5/1994 |
| JP | 2001-279378 | 10/2001 |
| JP | 2002-060898 | 2/2002 |
| JP | 2003-073773 | 3/2003 |
| JP | 2004-317203 | 11/2004 |
| JP | 2005-105361 | 4/2005 |
| JP | 2006-161139 | 6/2006 |
| JP | 2008-019502 | 1/2008 |
| JP | 2008-156734 | 7/2008 |
| RU | 2258762 | 8/2005 |
| RU | 2312163 | 12/2007 |

OTHER PUBLICATIONS

Mexican Office Action dated Jun. 26, 2013 issued in corresponding Mexican Application No. MX/a/2011/012371 [With English Translation].

International Search Report in PCT/JP2010/003541 dated Aug. 31, 2010.

Nakashima, K., Estimation of Dislocation Density by X-Ray Diffraction Method, Kyushu University Department of Materials Science and Engineering, CAMP-ISIJ, vol. 17 (2004)-396.

Russian Notice of Allowance, dated Jan. 17, 2013, issued in corresponding Russian application No. 2011147043.

Search Report dated May 14, 2014 issued in corresponding European Application No. 10780277.9.

* cited by examiner (a)

TEM × 5000

(b)

TEM × 100000

(c)

TEM × 100000

(a)

TEM × 5000

(b)

TEM × 50000

HIGH-STRENGTH STEEL SHEET, HOT-DIPPED STEEL SHEET, AND ALLOY HOT-DIPPED STEEL SHEET THAT HAVE EXCELLENT FATIGUE, ELONGATION, AND COLLISION CHARACTERISTICS, AND MANUFACTURING METHOD FOR SAID STEEL SHEETS

TECHNICAL FIELD

The present invention relates to a high-strength steel sheet, a hot-dipped steel sheet, and an alloyed hot-dipped steel sheet which are steel sheets for automobiles and are mainly subjected to press working. In particular, the present invention relates to a high-strength steel sheet, a hot-dipped steel sheet, an alloyed hot-dipped steel sheet, and production methods thereof, and these steel sheets have excellent fatigue properties and excellent collision properties with a sheet thickness of about 6.0 mm or less and a tensile strength of 590 MPa or more.

This application is a national stage application of International Application No. PCT/JP2010/003541, filed May 26, 2010, which claims priority to Japanese Patent Application No. 2009-127340 filed on May 27, 2009, the content of which is incorporated herein by reference.

BACKGROUND ART

In recent years, for the purpose of reducing weight and enhancing safety of an automobile, an increase in the strength of automobile components and materials used therein has been made, and with regard to steel sheets which are representative materials for the automobile components, a rate of use of a high-strength steel sheet has been increased. In order to achieve the reduction in weight while enhancing safety, it is necessary to increase a collision energy absorbing ability while increasing the strength. For example, it is effective to increase a yield stress of a steel material; and thereby, a collision energy can be absorbed efficiently with a low deformation amount. In particular, as a material used in the vicinity of a cabin of an automobile, materials having high yield stresses are widely used because there is a need to block a colliding object invading the cabin from the point of view of occupant protection. Particularly, the demand for a high-strength steel sheet having a tensile strength in a range of 590 MPa or more, and a high-strength steel sheet having a tensile strength in a range of 780 MPa or more has been increasing.

In general, as methods of increasing a yield stress, there are (1) a method of work-hardening a steel sheet by performing cold rolling, (2) a method of forming a microstructure including a low-temperature transformation phase (bainite or martensite) having a high dislocation density as a main phase, (3) a method of performing precipitation strengthening by adding microalloying elements, and (4) a method of adding solid-solution strengthening elements such as Si and the like. Among them, with regard to the methods (1) and (2), the dislocation density in the microstructure is increased; and thereby, workability during press forming is deteriorated drastically. This results in further deterioration of press formability of a high-strength steel sheet which originally has insufficient in workability. On the other hand, in the method (4) of performing solid-solution strengthening, the absolute value of a strengthening amount is limited; and therefore, it is difficult to increase the yield strength to a sufficient extent. Accordingly, in order to efficiently increase the yield stress while obtaining high workability, it is preferable that microalloying elements such as Nb, Ti, Mo, and V are added to perform precipitation strengthening of alloy carbonitrides for achieving a high yield stress.

From the above viewpoint, a high-strength hot-rolled steel sheet in which precipitation strengthening of microalloying elements is utilized has been put to practical use. However, the high-strength hot-rolled steel sheet in which the precipitation strengthening is utilized mainly has two problems. One is fatigue properties and the other is rust prevention.

With regard to the fatigue properties as the first problem, in the high-strength hot-rolled steel sheet in which precipitation strengthening is utilized, there is a phenomenon in which a fatigue strength is reduced due to softening of the surface layer of the steel sheet. In the surface of the steel sheet which directly comes into contact with a rolling roll during hot rolling, the temperature of only the surface of the steel sheet is reduced due to a heat releasing effect of the roll which comes into contact with the steel sheet. When the temperature of the outermost layer of the steel sheet falls below an $Ar_3$ point, coarsening of the microstructure and precipitates occur; and thereby, the outermost layer of the steel sheet is softened. This is the main factor of the deterioration of the fatigue strength. In general, a fatigue strength of a steel material is increased as the outermost layer of the steel sheet is hardened. Therefore, in a high-tensile hot-rolled steel sheet in which precipitation strengthening is utilized, it is difficult to obtain a high fatigue strength at present. On the other hand, the purpose of increasing the strength of a steel sheet is to reduce the weight of an automobile body; however, the sheet thickness cannot be reduced in the case where the fatigue strength ratio is reduced while the strength of the steel sheet is increased. From this point of view, it is preferable that the fatigue strength ratio be in a range of 0.45 or more, and even in the hot-rolled high-tensile steel sheet, it is preferable that the tensile strength and the fatigue strength be maintained at high values with a good balance. Here, the fatigue strength ratio is a value obtained by dividing the fatigue strength of a steel sheet by the tensile strength. In general, there is a tendency that a fatigue strength increases as a tensile strength increases. However, in a material with higher strength, the fatigue strength ratio is reduced. Therefore, even though a steel sheet having a high tensile strength is used, since the fatigue strength is not increased, there may be a case where a reduction in the weight of the automobile body which is the purpose of increasing strength cannot be realized.

The other problem is rust prevention. Typically, as a steel sheet used in a chassis frame for an automobile, a cold-rolled steel sheet produced by cold rolling and annealing thereafter and an alloyed hot-dip galvanized steel sheet are not used, but a hot-rolled steel sheet having a relatively thick thickness in a range of 2.0 mm or more is mainly used. In the vicinity of a chassis where a paint on the surface of the steel sheet is easily peeled off due to physical contact with curbs, flying stones, or the like, a material having a thicker thickness than that required from a design stress is selected to be used in consideration of a corrosion thickness reduction amount (amount of reduced sheet thickness due to corrosion) during a service life; and thereby, the quality is guaranteed. Therefore, with regard to the chassis frame and the like, the reduction in weight by substituting the material to a high-strength steel sheet is delayed at present, compared to body components. Since the sheet thickness is thick as one of the characteristics of chassis components, arc welding is mainly conducted for welding the components. Since the arc welding has a higher heat input amount than that of spot welding, HAZ softening is more likely to occur. In order to obtain properties of being resistant to HAZ softening, precipitation strengthening by an addition of microalloying elements is mainly utilized. Therefore, it is difficult to apply a hot-dip galvanized steel sheet or an alloyed hot-dip galvanized steel sheet having high rust prevention properties because annealing is conducted after cold rolling for the purpose of structure strengthening in the manufacture of these galvanized steel sheets. The reason that the precipitation strengthening by an addition of microalloying elements cannot be utilized for the steel sheet produced by performing annealing after cold rolling is described as follows. Even in the case where a hot-rolled steel sheet into which microalloying elements are added is subjected to a cold rolling at a high cold rolling rate (for example, 30% or higher) and then annealing is conducted at a temperature in a range of an $A_3$ point or less, the microalloying elements suppress recovery and recrystallization of ferrite. Therefore, a microstructure is work-hardened in a state of being cold-rolled; and as a result, workability is deteriorated drastically. On the other hand, in the case where heating is performed at a temperature in a range of the $A_3$ point or higher, precipitates coarsen; and as a result, there is a problem in that a sufficient increase in the yield strength is not obtained. Therefore, the precipitation strengthening by the addition of microalloying elements cannot be utilized.

As a hot-dip galvanized steel sheet which includes a hot-rolled steel sheet, Patent Document 1 discloses a method of producing a hot-dip galvanized steel sheet having a tensile strength in a range of 38 to 50 kgf/mm$^2$. With regard to the steel sheet having such a strength level, a desired strength level is obtained without utilizing precipitation strengthening due to an addition of microalloying elements. However, methods of producing a high-strength steel sheet, a hot-dipped steel sheet, and an alloyed hot-dipped steel sheet, which have excellent collision properties and fatigue strength with a strength in a strength level of 590 MPa or more are not disclosed yet.

PRIOR ART DOCUMENT

Patent Document

Patent Document 1: Japanese Examined Patent Application, Publication No. H06-35647

DISCLOSURE OF THE INVENTION

Problems to be Solved by the Invention

In order to solve the above-described problems, the present invention aims to provide a high-strength steel sheet, a hot-dipped steel sheet, an alloyed hot-dipped steel sheet, and production methods thereof, and these steel sheets have a tensile strength in a range of 590 MPa or more, and are excellent in fatigue properties, elongation, and collision properties.

Means for Solving the Problems

The high-strength steel sheet of the present invention having excellent fatigue properties, elongation and collision properties, includes: in terms of percent by mass, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.15% of Ti; and 0.01% or less of N; and contains as the balance, iron and inevitable impurities. A tensile strength is in a range of 590 MPa or more, and a ratio of a yield strength to the tensile strength is in a range of 0.80 or more. A microstructure includes bainite at an area ratio of 40% or more and the balance being either one or both of ferrite and martensite. A density of Ti(C,N) precipitates having sizes of 10 nm or smaller is in a range of $10^{10}$ precipitates/mm$^3$ or more. A ratio (Hvs/Hvc) of a hardness (Hvs) at a depth of 20 μm from a surface to a hardness (Hvc) at a center of a sheet thickness is in a range of 0.85 or more.

In the high-strength steel sheet of the present invention having excellent fatigue properties, elongation and collision properties, a fatigue strength ratio may be in a range of 0.45 or more.

An average dislocation density may be in a range of $1\times10^{14}$ m$^{-2}$ or less.

The high-strength steel sheet may further include one or more selected from the group consisting of: in terms of percent by mass, 0.005 to 0.1% of Nb; 0.005 to 0.2% of Mo; 0.005 to 0.2% of V; 0.0005 to 0.005% of Ca; 0.0005 to 0.005% of Mg; 0.0005 to 0.005% of B; 0.005 to 1% of Cr; 0.005 to 1% of Cu; and 0.005 to 1% Ni.

The hot-dipped steel sheet of the present invention having excellent fatigue properties, elongation and collision properties, includes: the high-strength steel sheet of the present invention described above; and a hot-dipped layer provided on the surface of the high-strength steel sheet.

In the hot-dipped steel sheet of the present invention having excellent fatigue properties, elongation and collision properties, the hot-dipped layer may consist of zinc.

The alloyed hot-dipped steel sheet of the present invention having excellent fatigue properties, elongation and collision properties, includes: the high-strength steel sheet of the present invention described above; and an alloyed hot-dipped layer provided on the surface of the high-strength steel sheet.

The method for producing the high-strength steel sheet of the present invention having excellent fatigue properties, elongation and collision properties, the method includes: heating a slab including: in terms of percent by mass %, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.15% of Ti; and 0.01% or less of N; and containing as the balance, iron and inevitable impurities, at a temperature in a range of 1,150 to 1,280° C. and performing hot rolling under conditions where a finish rolling is finished at a temperature in a range of not less than an $Ar_3$ point, thereby obtaining a hot-rolled material; coiling the hot-rolled material in a temperature range of 600° C. or less, thereby obtaining a hot-rolled steel sheet; subjecting the hot-rolled steel sheet to acid pickling; subjecting the pickled hot-rolled steel sheet to first skin pass rolling at an elongation rate in a range of 0.1 to 5.0%; annealing the hot-rolled steel sheet under conditions where a maximum heating temperature (Tmax° C.) is in a range of 600 to 750° C. and a holding time (t seconds) in a temperature range of 600° C. or higher fulfills Expressions (1) and (2) as follows; and subjecting the annealed hot-rolled steel sheet to second skin pass rolling.

$$530-0.7\times T\max\leq t\leq 3{,}600-3.9\times T\max \quad (1)$$

$$t>0 \quad (2)$$

In the method for producing the high-strength steel sheet of the present invention having excellent fatigue properties, an elongation rate may be set to be in a range of 0.2 to 2.0% in the second skin pass rolling.

½ or more of the amount of Ti contained in the hot-rolled steel sheet after the coiling may exist in a solid-solution state.

The method for producing the hot-dipped steel sheet of the present invention having excellent fatigue properties, elongation and collision properties, the method includes: heating a slab including: in terms of percent by mass %, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.15% of Ti; and 0.01% or less of N; and containing as the balance, iron and inevitable impurities, at a temperature in a range of 1,150 to 1,280° C. and performing hot rolling under conditions where a finish rolling is finished at a temperature in a range of not less than an $Ar_3$ point, thereby obtaining a hot-rolled material; coiling the hot-rolled material in a temperature range of 600° C. or less, thereby obtaining a hot-rolled steel sheet; subjecting the hot-rolled steel sheet to acid pickling; subjecting the pickled hot-rolled steel sheet to first skin pass rolling at an elongation rate in a range of 0.1 to 5.0%; annealing the hot-rolled steel sheet under conditions where a maximum heating temperature (Tmax° C.) is in a range of 600 to 750° C. and a holding time (t seconds) in a temperature range of 600° C. or higher fulfills Expressions (1) and (2) as follows, and performing hot dipping to form a hot-dipped layer on a surface of the hot-rolled steel sheet, thereby obtaining a hot-dipped steel sheet; and subjecting the hot-dipped steel sheet to second skin pass rolling.

$$530-0.7\times T\max \leq t \leq 3{,}600-3.9\times T\max \quad (1)$$

$$t>0 \quad (2)$$

In the method for producing the hot-dipped steel sheet of the present invention having excellent fatigue properties, elongation and collision properties, an elongation rate may be set to be in a range of 0.2 to 2.0% in the second skin pass rolling.

The method for producing the alloyed hot-dipped steel sheet of the present invention having excellent fatigue properties, elongation and collision properties, the method includes: heating a slab comprising: in terms of percent by mass %, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.15% of Ti; and 0.01% or less of N; and containing as the balance, iron and inevitable impurities, at a temperature in a range of 1,150 to 1,280° C. and performing hot rolling under conditions where a finish rolling is finished at a temperature in a range of not less than an $Ar_3$ point, thereby obtaining a hot-rolled material; coiling the hot-rolled material in a temperature range of 600° C. or less, thereby obtaining a hot-rolled steel sheet; subjecting the hot-rolled steel sheet to acid pickling; subjecting the pickled hot-rolled steel sheet to first skin pass rolling at an elongation rate in a range of 0.1 to 5.0%; annealing the hot-rolled steel sheet under conditions where a maximum heating temperature (Tmax° C.) is in a range of 600 to 750° C. and a holding time (t seconds) in a temperature range of 600° C. or higher fulfills Expressions (1) and (2) as follows, performing hot dipping to form a hot-dipped layer on a surface of the hot-rolled steel sheet so as to obtain a hot-dipped steel sheet, and subjecting the hot-dipped steel sheet to an alloying treatment to convert the hot-dipped layer into an alloyed hot-dipped layer; and subjecting the hot-dipped steel sheet on which the alloying treatment is performed to second skin pass rolling.

$$530-0.7\times T\max \leq t \leq 3{,}600-3.9\times T\max \quad (1)$$

$$t>0 \quad (2)$$

In the method for producing the alloyed hot-dipped steel sheet of the present invention having excellent fatigue properties, elongation and collision properties, an elongation rate may be set to be in a range of 0.2 to 2.0% in the second skin pass rolling.

Effects of the Invention

In the method for producing the high-strength steel sheet of the present invention, a tensile strength in a range of 590 MPa or more is realized by fulfilling the above-described component composition. In addition, Ti is added, and in the hot rolling stage, precipitation of alloy carbonitrides is suppressed by adjusting the coiling temperature, and in the annealing stage, alloy carbonitrides are precipitated by adjusting the heating temperature and the holding time. As a result, precipitation strengthening is applied; and thereby, a high yield stress is realized. Therefore, a high collision energy absorbing ability (excellent collision properties) can be achieved. In addition, by performing the skin pass before the annealing, strains are introduced only to the surface layer of the steel sheet. This strains become precipitation sites of alloy carbonitrides during the annealing step; and therefore, precipitation of carbonitrides at or in the vicinity of the surface layer of the steel sheet can be accelerated during the annealing. Thereby, softening of the surface layer can be suppressed. As a result, Hvs/Hvc of the steel sheet can be set to be in a range of 0.85 or more; and thereby, high fatigue strength ratio (excellent fatigue properties) can be achieved. In addition, by performing the skin pass at a predetermined elongation rate, excellent elongation (excellent workability) can be achieved.

Since the high-strength steel sheet of the present invention has the above-described component composition and the microstructure, a tensile strength in a range of 590 MPa or more and excellent elongation (excellent workability) can be realized. In addition, since a density of Ti(C,N) precipitates having sizes of 10 nm or smaller is in a range of $10^{10}$ precipitates/$mm^3$ or more, a high yield stress is realized. Therefore, a high collision energy absorbing ability (excellent collision properties) can be achieved. In addition, since a ratio (Hvs/Hvc) is in a range of 0.85 or more, a high fatigue strength ratio (excellent fatigue properties) can be achieved.

The hot-dipped steel sheet of the present invention and the alloyed hot-dipped steel sheet of the present invention can achieve the same effects as those of the high-strength steel sheet described above and excellent rust prevention.

Accordingly, the present invention can provide a high-strength steel sheet, a hot-dipped steel sheet, and an alloyed hot-dipped steel sheet, which have a tensile strength in a range of 590 MPa or more and excellent fatigue properties, elongation and collision properties, and production methods thereof.

BEST MODE FOR CARRYING OUT THE INVENTION

Figure 1:
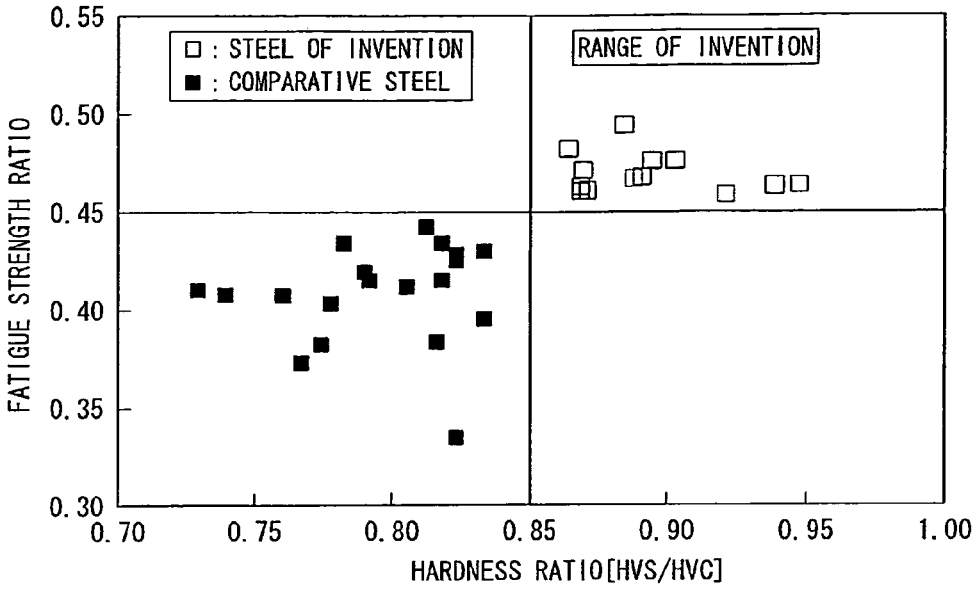
FIG. 1 is a graph showing a relationship between Hvs/Hvc and a fatigue strength ratio.

Details of the present invention will be described below.

The inventors have focused on the fact that in order to produce a high-strength steel sheet, a hot-dipped steel sheet, or an alloyed hot-dipped steel sheet having excellent fatigue properties, elongation, and collision properties which cannot be achieved in the prior art, precipitation strengthening due to microalloying elements such as Ti, Nb, Mo, and V has to be utilized sufficiently, and have examined influences of alloy components and production conditions on precipitation behaviors.

That is, the inventors examined the precipitation behaviors of alloy carbonitrides of Ti, Nb, Mo, and V which occur during the production of a high-strength steel sheet, a hot-dipped steel sheet, or an alloyed hot-dipped steel sheet. In detail, the inventors examined a coiling temperature of a hot-rolled material, annealing conditions in an annealing step (including galvanization step), and an influence of dislocations introduced to the surface of the steel sheet during skin pass rolling performed after acid-pickling the hot-rolled steel sheet. Then, the inventors examined an influence on fatigue properties, elongation, and collision properties.

As a result, the inventors found that in order to realize a high yield stress by utilizing the precipitation strengthening for the purpose of improving collision properties, it is preferable to suppress precipitation of alloy carbonitrides in a hot rolling stage and to precipitate the alloy carbonitrides in a matrix so as to perform precipitation strengthening in an annealing stage. Further, the inventors thought that in order to increase the hardness of the surface layer of the steel sheet which has a large influence on the fatigue properties, it is effective to precipitate the alloy carbonitrides at or in the vicinity of the surface layer of the steel sheet in the annealing stage. In addition, the inventors found that as a method for accelerating precipitation of alloy carbonitrides, it is effective to perform skin pass rolling so as to intensively introduce strains only to the surface layer and the vicinity thereof in the steel sheet after performing hot rolling and acid pickling. It is effective to increase precipitation sites of alloy carbonitrides by the skin pass rolling, and these alloy carbonitrides precipitate during annealing; and thereby, an increase in the strength is extended due to precipitation strengthening. In addition, the inventors also found that the surface roughness is improved and the surface layer is work-hardened by subjecting the steel sheet to skin pass rolling at a rolling rate of 1.0% or more after completing the annealing; and thereby, the fatigue properties are further improved.

Accordingly, it becomes possible to produce a steel sheet having a high yield stress which could not be achieved by a production method of a high-strength steel sheet, a hot-dipped steel sheet, or an alloyed hot-dipped steel sheet of the prior art. Specifically, by performing annealing after the skin pass rolling, the surface layer and the vicinity thereof are hardened by precipitation strengthening due to the alloy carbides; and thereby, fatigue properties are improved. In addition, by the skin pass rolling after the annealing, the surface roughness is further improved, and the surface layer and the vicinity thereof are work-hardened. Accordingly, the fatigue properties are further enhanced.

Next, the high-strength steel sheet of the present invention will be described. At first, the reasons for limitations associated with the components of the steel sheet are described.

The C content is set to be in a range of 0.03 to 0.10%. In the case where the C content is less than 0.03%, the strength is degraded, and 590 MPa which is a target tensile strength cannot be achieved. In addition, a degree of hardening of the surface layer of the steel sheet after annealing is reduced. Therefore, the C content is set to be in a range of 0.03% or more. On the other hand, in the case where the C content exceeds 0.10%, the strength is increased excessively; and thereby, elongation is deteriorated drastically. Therefore, in practice, it becomes difficult to form, and furthermore, weldability is deteriorated drastically. Therefore, the C content is set to be in a range of 0.10% or less.

The C content is preferably in a range of 0.06 to 0.09%. In this case, a tensile strength of 590 MPa or more is obtained, and a fatigue strength ratio of 0.45 or more is also obtained.

Si is a solid-solution strengthening element and is effective in increasing the strength; and therefore, as the Si content is increased, the balance between tensile strength and elongation is improved. However, when the Si content is too large, Si has an influence on wettability of galvanization and chemical conversion properties. Therefore, the upper limit of the Si content is set to be 1.5%. In addition, since Si is used for deoxidizing and Si is incorporated inevitably, the lower limit thereof is set to be 0.01%.

It is preferable that the Si content be in a range of 1.2% or less. There may be cases where problems with wettability of galvanization or chemical conversion properties occur due to an influence of conditions during hot rolling or an atmosphere during continuous annealing. Therefore, the upper limit of the Si content is preferably 1.2%.

The Mn content is set to be in a range of 1.0 to 2.5%. Mn is an effective element in enhancing solid-solution strengthening and hardenability; however, 590 MPa which is a target tensile strength cannot be achieved in the case where the Mn content is less than 1.0%. Therefore, the Mn content is set to be in a range of 1.0% or more. On the other hand, in the case where the Mn content exceeds 2.5%, segregation is more likely to occur, and press formability is deteriorated. In practice, the Mn content is preferably in a range of 1.0 to 1.8% with regard to the steel sheet having a tensile strength of 590 to 700 MPa, and the Mn content is preferably in a range of 1.6 to 2.2% with regard to the steel sheet having a tensile strength of 700 MPa to 900 MPa, and the Mn content is preferably in a range of 2.0 to 2.5% with regard to the steel sheet having a tensile strength of 900 MPa or more. There is a suitable Mn amount range depending on the tensile strength, and an excessive addition of Mn causes deterioration of workability due to Mn segregation. Therefore, it is preferable that the Mn content be adjusted in accordance with the tensile strength as described above.

P acts as a solid-solution strengthening element and increases the strength of the steel sheet. However, when the P content is too large, workability or weldability of the steel sheet is degraded, which is not preferable. In particular, in the case where the P content exceeds 0.1%, degradation of the workability or weldability of the steel sheet becomes notable.

Therefore, the P content is preferably set to be in a range of 0.1% or less and is more preferably set to be in a range of 0.02% or less.

In the case where the S content is too large, inclusions such as MnS are generated; and thereby, stretch flangeability is degraded, and furthermore, cracks occur during hot rolling. Therefore, it is preferable that the S content be reduced to be as low as possible. In particular, in order to prevent the occurrence of cracks during hot rolling and obtain good workability, the S content is preferably set to be in a range of 0.02% or less, and is more preferably set to be in a range of 0.01% or less.

The Al content is set to be in a range of 0.01 to 1.2%. By adding Al as a deoxidizing element, the amount of dissolved oxygen in a molten steel can be efficiently reduced. In the case where the Al content is in a range of 0.01% or more, it is possible to prevent Ti, Nb, Mo, and V which are important elements in the present invention from forming alloy oxides with dissolved oxygen. In this manner, Al is used for deoxidizing; however, Al is incorporated inevitably. Therefore, the lower limit of the Al content is set to be 0.01%, and the Al content is preferably in a range of 0.02% or more. On the other hand, in the case where the Al content exceeds 1.2%, Al becomes a factor that deteriorates galvanizing properties and chemical conversion properties. Therefore, the Al content is set to be in a range of 1.2% or less and is preferably set to be in a range of 0.6% or less.

Figure 8:
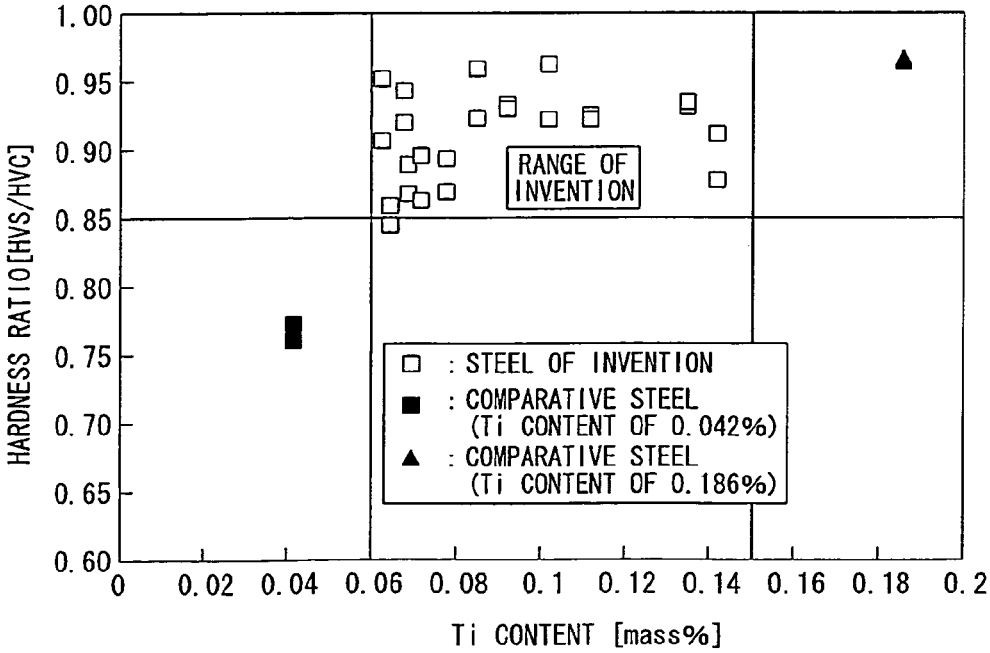
FIG. 8 is a graph showing a relationship between Ti amount and a hardness ratio.
Figure 9:
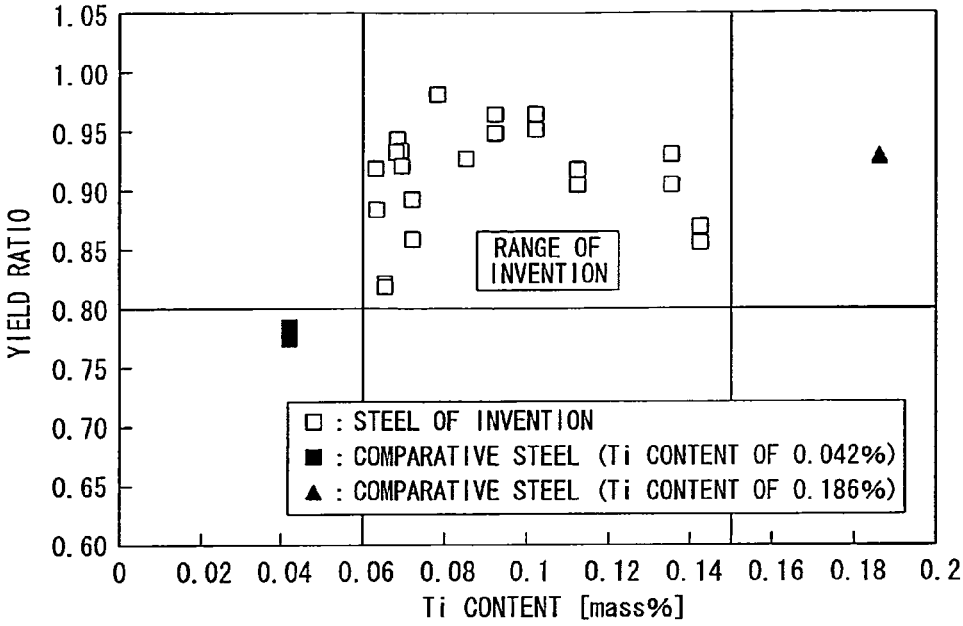
FIG. 9 is a graph showing a relationship between Ti amount and a yield ratio.
Figure 10:
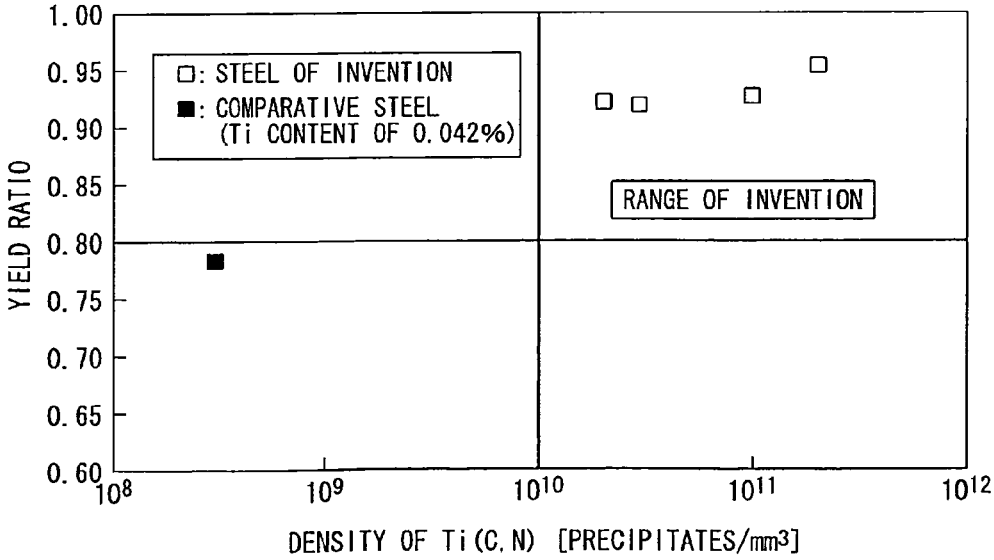
FIG. 10 is a graph showing a relationship between density of Ti(C,N) precipitates and a yield ratio.

Ti is an important element important in the present invention. Ti is an important element for precipitation strengthening of the steel sheet during annealing after hot rolling. In the production process, it is necessary to maintain a solid solution state while suppressing the amount of formed precipitates as low as possible in a hot rolling stage (a stage from hot rolling to coiling); and therefore, a coiling temperature during the hot rolling is set to be in a range of 600° C. or less at which Ti precipitates are less likely to be generated. In addition, skin pass rolling is performed before annealing; and thereby, dislocations are introduced. Next, in an annealing stage, Ti(C,N) is finely precipitated on the introduced dislocations. In particular, at or in the vicinity of the surface layer of the steel sheet where a dislocation density is increased, the effect (fine precipitation of Ti(C,N)) becomes notable. Due to this effect, it becomes possible to attain Hvs/Hvc≥0.85, and high fatigue properties can be achieved. In addition, by precipitation strengthening due to an addition of Ti, a yield ratio which is a ratio of a yield strength to a tensile strength can be in a range of 0.80 or more. Among many precipitation strengthening elements, Ti has the highest precipitation strengthening ability. This is because a difference between the solubility of Ti in a $\gamma$ phase and the solubility of Ti in an $\alpha$ phase is large. In order to achieve a tensile strength of 590 MPa or more, Hvs/Hvc≥0.85, and a yield ratio of 0.80 or more, it is necessary to set the Ti content to be in a range of 0.06% or more as shown in FIGS. 8 and 9. In the case where the Ti content is less than 0.06%, as shown in FIG. 10, a precipitate density of Ti(C,N) having sizes of 10 nm or smaller becomes less than $10^{10}$ pieces/$mm^3$; and thereby, a high yield ratio is not obtained. Ti contributes to precipitation strengthening, and in addition, Ti is an element which delays a rate of recrystallization of austenite during hot rolling. Therefore, in the case where the Ti content is excessive, the texture of the hot-rolled steel sheet is developed; and thereby, anisotropy after annealing is increased. In concrete, in the case where the Ti content exceeds 0.12%, the anisotropy of the steel sheet is increased, and in the case where the Ti content exceeds 0.15%, the anisotropy of the steel sheet is particularly increased. As a result, workability is degraded. Therefore, the upper limit of the Ti content is set to be 0.15% and is preferably set to be 0.12%.

N forms TiN; and thereby, workability of the steel sheet is degraded. Therefore, it is preferable that the N content be as low as possible. In particular, in the case where the N content exceeds 0.01%, coarse TiN is generated; and thereby, the workability of the steel sheet is deteriorated, and in addition, the amount of Ti which does not contribute to precipitation strengthening is increased. Therefore, it is preferable that the N content be set to be in a range of 0.01% or less.

The steel sheet of the present invention includes the above-described elements and the balance which is iron and inevitable impurities. As needed, one or more selected from Nb, Mo, V, Ca, Mg, B, Cr, Cu, and Ni described as follows may further be contained.

Nb is an important element as a precipitation strengthening element like Ti. However, in the case where the Nb content is less than 0.005%, the effect is small. Therefore, the lower limit of the Nb content is set to be 0.005%. In addition, as is the case with Ti, Nb has an effect of delaying the rate of recrystallization of austenite during hot rolling. Therefore, in the case where the Nb content is excessive, workability is deteriorated. In concrete, in the case where the Nb content exceeds 0.1%, an increase in the strength by the precipitation strengthening is saturated, and in addition, elongation is degraded. Therefore, the upper limit of the Nb content is set to be 0.1%. In the case where Nb is contained together with Ti, the effect of making grain sizes fine becomes prominent. Therefore, it is preferable that the Nb content be in a range of 0.02 to 0.05%, and in this case, the above-described effect is obtained drastically.

As is the case with Ti and Nb, Mo and V are precipitation strengthening elements. In the case where the Mo content and the V content are each less than 0.005%, the effect is small. In addition, in the case where the Mo content and the V content each exceed 0.2%, the effect of improving the precipitation strengthening is small, and in addition, elongation is deteriorated. Therefore, the Mo content and the V content are each set to be in a range of 0.005 to 0.2%.

Ca forms CaS which is a compound with S and is bonded to S. As a result, there is an effect of suppressing generation of MnS. Mg has an effect of making inclusions fine. In the case where the Ca content and the Mg content each exceed 0.005%, the amount of inclusions is increased due to the excessive addition; and thereby, hole expandability is deteriorated. Therefore, the upper limits thereof are set to be 0.005%. In addition, in the case where the Ca content and the Mg content are each less than 0.0005%, the above-described effect is not sufficiently obtained. Therefore, it is preferable that the lower limits thereof be 0.0005%.

B is an element which can improve hardenability drastically. Therefore, in the case where sufficient cooling ability is not obtained due to the limitation of equipment in a hot rolling line, or in the case where cracks are generated in grain boundaries due to secondary work embrittlement, B is contained as needed for the purpose of strengthening grain boundaries. In the case where the B content exceeds 0.005%, improvement of the hardenability is not obtained in practice; and therefore, the upper limit of the B content is set to be 0.005%. In the case where the B content is less than 0.0005%, the above-described effect is not sufficiently obtained. Therefore, it is preferable that the lower limit of the B content be 0.0005%.

As is the case with Mn, Cr is one of elements effective in enhancing hardenability. Therefore, as the Cr content is increased, the tensile strength of the steel sheet is increased. In the case where the Cr content is large, Cr-based alloy carbides such as $Cr_{23}C_6$ are precipitated, and when these carbides are preferentially precipitated in the grain boundaries, press formability is deteriorated. Therefore, the upper limit of the Cr content is set to be 1%. In addition, in the case where the Cr content is less than 0.005%, the above-described effect is not sufficiently obtained. Therefore, it is preferable that the lower limit of the Cr content be 0.005%.

Cu has an effect of increasing the strength of the steel material due to precipitation thereof. Alloy elements such as Ti are bonded to C or N and form alloy carbides; however, Cu is precipitated solely and strengthens the steel material. However, a steel material containing a large amount of Cu embrittles during hot rolling. Therefore, the upper limit of the Cu content is set to be 1%. In addition, in the case where the Cu content is less than 0.005%, the above-described effect is not sufficiently obtained. Therefore, it is preferable that the lower limit of the Cu content be 0.005%.

As is the case with Mn, Ni enhances hardenability of the steel material, and in addition, Ni contributes to the improvement of toughness. Furthermore, Ni has an effect of preventing hot brittleness in the case of including Cu. However, since alloy costs are very expensive, the upper limit of the Ni content is set to be 1%. In the case where the Ni content is less than 0.005%, the above-described effect is not sufficiently obtained. Therefore, it is preferable that the lower limit of the Ni content be 0.005%.

Next, the microstructure of the steel sheet which is one of the characteristics of the present invention will be described.

According to the present invention, the microstructure includes bainite at an area ratio of 40% or more and the balance being either one or both of ferrite and martensite. Here, the microstructure is a microstructure in a sheet thickness center portion which is observed by taking a sample from a portion of the steel sheet that is ¼ of the sheet thickness inner from the surface.

In the present invention, in the case where the area ratio of bainite is in a range of 40% or more, an increase in the strength due to precipitation strengthening can be expected. That is, a temperature at which the hot-rolled material is coiled is set to be in a range of 600° C. or less so as to ensure solid-solution Ti in the hot-rolled steel sheet, and this temperature is close to the bainite transformation temperature. Therefore, a large amount of bainite is included in the microstructure of the hot-rolled steel sheet, and transformation dislocations which area introduced simultaneously with transformation increase an amount of TiC nucleation sites during annealing; and thereby, higher precipitation strengthening can be achieved. The area ratio of bainite is changed drastically due to a cooling history during hot rolling; however, the area ratio of bainite is adjusted depending on the needed material properties. The area ratio of bainite is preferably in a range of more than 70%. In this case, the increase in the strength due to the precipitation strengthening is further enhanced, and in addition, an amount of coarse cementite which is inferior in press formability is reduced; and thereby, press formability can be maintained properly. The upper limit of the area ratio of bainite is preferably 90%.

In the present invention, in the production process, in the hot rolling stage (a stage from hot rolling to coiling), Ti in the hot-rolled steel sheet is maintained in a solid-solution state, and then strains are introduced to the surface layer by skin pass rolling after the hot rolling. Thereafter, in the annealing stage, Ti(C,N) is precipitated in the surface layer while utilizing the introduced strains as nucleation sites. As a result, fatigue properties are improved. Therefore, it is important to complete (finish) the hot rolling in a temperature range of 600° C. or less where precipitation of Ti is less likely to proceed. That is, it is important to coil the hot-rolled material at a temperature in a range of 600° C. or less. In the structure of the hot-rolled steel sheet obtained by coiling the hot-rolled material (the structure in the hot rolling stage), the fraction of bainite may be arbitrary. In particular, in the case where high elongation is desired for products (high-strength steel sheet, hot-dipped steel sheet, and alloyed hot-dipped steel sheet), it is effective to increase the fraction of ferrite during hot rolling. On the other hand, in the case where hole expandability is considered to be important, the hot-rolled material may be coiled at lower temperature; and thereby, the microstructure including bainite and martensite as main phases may be formed.

As described above, since coiling is performed at a temperature in a range of 600° C. or less so as to ensure the amount of solid-solution Ti in the hot-rolled steel sheet, the microstructure of the hot-rolled steel sheet (the microstructure in the hot rolling stage) substantially consists of bainite and the balance being either one or both of ferrite and martensite. Thereafter, the hot-rolled steel sheet is heated to 600° C. or higher in the annealing; and thereby, bainite and martensite are tempered. In general, tempering means reducing a dislocation density by a heat treatment. Bainite and martensite generated at a temperature in a range of 600° C. or less are tempered during the annealing. Therefore, it can be said that bainite and martensite in the microstructure of the products are tempered bainite and tempered martensite in practice. The tempered bainite and the tempered martensite are distinguished from general bainite and martensite because the tempered bainite and the tempered martensite have low dislocation densities as follows.

The microstructure of the hot-rolled steel sheet in the hot rolling stage contains bainite and martensite; and therefore, the dislocation density is high. However, since bainite and martensite are tempered during the annealing, the dislocation density is reduced. In the case where an annealing time is insufficient, the dislocation density is maintained at high value; and as a result, elongation becomes low. Therefore, it is preferable that the average dislocation density of the steel sheet after annealing be in a range of $1\times10^{14}$ $m^{-2}$ or less. In the case where the annealing is performed under conditions that fulfill Expressions (1) and (2) described later, the reduction in the dislocation density proceeds simultaneously with precipitation of Ti(C,N). That is, in a state where precipitation of Ti(C,N) proceeds sufficiently, the average dislocation density of the steel sheet is reduced. Typically, the reduction in the dislocation density causes a reduction in the yield stress of the steel material. However, in the present invention, Ti(C,N) is precipitated simultaneously with the reduction in the dislocation density; and therefore, a high yield stress is obtained.

In the present invention, a measurement method of the dislocation density is performed on the basis of "a method of measuring a dislocation density using X-ray diffraction" described in CAMP-ISIJ Vol. 17 (2004) p. 396, and the average dislocation density is calculated from the half-value widths of diffraction peaks of (110), (211), and (220).

Since the microstructure has the above-described properties, a high yield ratio and a high fatigue strength ratio can be achieved which are not achieved by a steel sheet that is produced by utilizing precipitation strengthening in the prior art. That is, even in the case where the microstructure at or in the vicinity of the surface layer of the steel sheet includes ferrite as a main phase and exhibits a coarse structure unlike the microstructure in the sheet thickness center portion, the hardness of the surface layer and the vicinity thereof in the steel sheet reaches a hardness substantially equivalent to that of the center portion of the steel sheet due to the precipitation of Ti(C,N) during annealing. As a result, generation of fatigue cracks is suppressed; and thereby, the fatigue strength ratio is increased.

Next, the reason for limitations associated with the tensile strength of the steel sheet which is the feature of the present invention will be described.

The tensile strength of the steel sheet of the present invention is in a range of 590 MPa or more. The upper limit of the tensile strength is not particularly limited. However, in a component range of the present invention, the upper limit of the practical tensile strength is about 1180 MPa.

Here, the tensile strength is evaluated by the following method. A No. 5 specimen described in JIS-Z2201 is produced, and then a tensile test is performed according to a test method described in JIS-Z2241.

In the present invention, a ratio (yield ratio) of the yield strength to the tensile strength which are obtained by the tensile test becomes 0.80 or more due to precipitation strengthening.

In order to attain a high yield ratio as in the present invention, precipitation strengthening due to Ti(C,N) and the like which is precipitated by the tempering of bainite is more important than transformation strengthening due to a hard phase such as martensite. In the present invention, a density of Ti(C,N) precipitates having sizes of 10 nm or smaller which is effective in precipitation strengthening is in a range of $10^{10}$ pieces/$mm^3$ or more. Thereby, a yield ratio in a range of 0.80 or more described above can be realized. Here, precipitates of which the equivalent circular diameter obtained by a square root of (major axis×minor axis) is larger than 10 nm does not have an influence on the properties obtained in the present invention. In contrast, as the size of the precipitate becomes smaller, precipitation strengthening due to Ti(C,N) is obtained more effectively; and as a result, there is a possibility that an added amount of alloy elements can be reduced. Therefore, a density of Ti(C,N) precipitates having grain sizes of 10 nm or smaller is defined.

Here, the precipitates are observed by the following method. A replica sample is produced according to a method described in Japanese Patent Application, First Publication No. 2004-317203, and then the replica sample is observed with a transmission electron microscope. The magnification of the field of view is set to be in a range of 5,000-fold magnification to 100,000-fold magnification, and the number of Ti(C,N) having sizes of 10 nm or smaller is counted from 3 or more fields of view. In addition, an electrolytic weight is obtained from a change in weight before and after electrolysis, and the weight is converted into a volume by a specific gravity of 7.8 ton/$m^3$. Then, the counted number is divided by the volume; and thereby, the precipitation density is calculated.

Next, the reasons for limitations associated with a hardness distribution of the steel sheet which is one of the characteristics of the present invention will be described.

The inventors have found that in order to improve fatigue properties, elongation, and collision properties in a high-strength steel sheet in which precipitation strengthening due to microalloying elements is utilized, fatigue properties are improved by setting a ratio of the hardness of the surface layer of the steel sheet to the hardness of the center portion of the steel sheet to be in a range of 0.85 or more. Here, the hardness of the surface layer of the steel sheet is a hardness at a portion that is 20 μm (at a depth of 20 μm) inner from the surface and is represented by Hvs. In addition, the hardness of the center portion of the steel sheet is a hardness at a portion that is ¼ of the sheet thickness (at a depth of ¼ of the sheet thickness) inner from the surface of the steel sheet and is represented by Hvc. The inventors have found that the fatigue properties are deteriorated in the case where the ratio Hvs/Hvc is less than 0.85, and on the other hand, the fatigue properties are improved in the case where the ratio Hvs/Hvc is 0.85 or more. Therefore, Hvs/Hvc is set to be in a range of 0.85 or more.

FIG. 1 shows a relationship between Hvs/Hvc and fatigue strength ratio. It can be seen that a fatigue strength ratio of 0.45 or more can be achieved in the case where Hvs/Hvc is in a range of 0.85 or more. Therefore, high fatigue properties are obtained. Here, in the case of the hot-dipped steel sheet or the alloyed hot-dipped steel sheet, the surface layer means a range excluding the plating thickness. That is, the hardness of the surface layer is a hardness at a portion which is not included in a hot-dipped layer or an alloyed hot-dipped layer and which is 20 μm inner from the surface of the high-strength steel sheet. In addition, the reason of determining the measurement portion of the hardness of the surface layer of the steel sheet to a portion that is 20 μm (at a depth of 20 μm) inner from the surface is described as follows. In practice, with regard to a steel sheet having a tensile strength of 590 MPa or more, the hardness is measured in a cross-section of the steel sheet using a Vickers hardness tester. Based on the premise of this measurement, the measurement portion is determined from the measurement ability. Therefore, in the case where it is possible to measure the hardness of the surface layer at a portion further closer to the surface by using a nanoindentation technique, the measurement portion may be determined based on the measurement ability. Here, in the case where measurement is performed at a portion different from the portion that is 20 μm (at a depth of 20 μm) inner from the surface, it is impossible to simply compare the absolute values of the measured Hvs and Hvc since the measurement methods are different. However, the threshold of Hvs/Hvc which is a ratio of these harnesses can be used as it is.

In the present invention, the type of the steel sheet which is a product is a high-strength steel which is obtained by subjecting a hot-rolled steel sheet to acid pickling and skin pass rolling and thereafter performing annealing thereon.

The hot-dipped steel sheet of the present invention includes the above-described high-strength steel sheet of the present invention, and the hot-dipped layer provided on the surface of the high-strength steel sheet. In addition, the alloyed hot-dipped steel sheet of the present invention includes the above-described high-strength steel sheet of the present invention, and the alloyed hot-dipped layer provided on the surface of the high-strength steel sheet.

As the hot-dipped layer and the alloyed hot-dipped layer, for example, layers consisting of either one or both of zinc and aluminum may be employed, and specifically, a hot-dip galvanized layer, an alloyed hot-dip galvanized layer, a hot-dip aluminized layer, an alloyed hot-dip aluminized layer, a hot-dip Zn—Al coated layer, an alloyed hot-dip Zn—Al coated layer, and the like may be employed. In particular, in terms of platability and corrosion resistance, a hot-dip galvanized layer and an alloyed hot-dip galvanized layer which consist of zinc are preferable.

The hot-dipped steel sheet or the alloyed hot-dipped steel sheet are produced by subjecting the above-described high-strength steel sheet of the present invention to hot dipping or alloyed hot-dipping. Here, the alloyed hot-dipping is a process of performing hot dipping to produce a hot-dipped layer on the surface and performing an alloying treatment thereon to make the hot-dipped layer into an alloyed hot-dipped layer.

The hot-dipped steel sheet or the alloyed hot-dipped steel sheet includes the high-strength steel sheet of the present invention, and the hot-dipped layer or the alloyed hot-dipped layer is formed on the surface; and therefore, the effects of the high-strength steel sheet of the present invention and excellent rust prevention can be achieved.

Next, a method for manufacturing the high-strength steel sheet of the present invention will be described.

First, a slab having the above-described component composition is re-heated at a temperature in a range of 1,150 to 1,280° C. As the slab, a slab immediately after being produced by continuous casting equipment, or a slab produced by an electric furnace may be used.

By setting the heating temperature of the slab to be in a range of 1,150° C. or more, carbide-forming elements and carbon can be sufficiently decomposed and dissolved into the steel material. However, in the case where the heating temperature of the slab exceeds 1,280° C., it is not preferable in terms of production costs; and therefore, the upper limit is set to be 1,280° C. In order to dissolve precipitated carbonitrides, it is preferable that the heating temperature be in a range of 1,200° C. or more.

Next, the re-heated slab is subjected to hot rolling under conditions where finish rolling is finished at a temperature in a range of the $Ar_3$ point or more; and thereby, a hot-rolled material is obtained. Then, the hot-rolled material is coiled in a temperature range of 600° C. or less; and thereby, a hot-rolled steel sheet is obtained.

In the case where a finishing temperature (a temperature at which finish rolling is finished) during the hot rolling is less than the $Ar_3$ point, precipitation of alloy carbonitrides or coarsening of grains proceeds in the surface layer; and thereby, the strength of the surface layer reduces notably. Therefore, excellent fatigue properties are not obtained. Consequently, in order to prevent deterioration of the fatigue properties, the lower limit of the finishing temperature during the hot rolling is set to be in a range of $Ar_3$ point or more. The upper limit of the finishing temperature is not particularly limited; however, in practice, the upper limit thereof is about 1,050° C.

Next, a cooling history from the finishing temperature during the hot rolling to the coiling will be described.

In the present invention, by setting the coiling temperature to be in a range of 600° C. or less, precipitation of alloy carbonitrides in the stage of the hot-rolled steel sheet (the stage from hot rolling to coiling) is suppressed. The coiling temperature is important, and the properties of the present invention are not degraded by the cooling history before the start of the coiling.

However, in the case where the ratio of the microstructure is adjusted so as to set the balance between elongation and hole expandability, which are mainly used as indexes of formability of a steel sheet for an automobile, to a desired value, it is necessary to control the cooling history from the finishing temperature to the start of coiling. For example, as a fraction of ferrite is increased, elongation is improved; however, hole expandability is deteriorated.

Therefore, in the case where a steel sheet is produced of which elongation is considered to be important, it is necessary to reduce the finishing temperature and to conduct air cooling in a temperature range immediately above a bainite starting temperature (Bs point) so as to cause ferrite transformation positively. In particular, it is preferable to positively cause ferrite transformation during hot rolling. Specifically, the finishing temperature is set to be in a range of the $Ar_3$ point or more to ($Ar_3$ point+50° C.) or less; and thereby, a lot of processing strains are introduced to austenite before transformation. Then, these strains are utilized as nucleation sites of ferrite, and a temperature is held in a temperature range in which ferrite transformation is most likely to proceed, specifically, from 600 to 680° C. for 1 to 10 seconds. In this manner, it is preferable that ferrite transformation be accelerated. After this intermediate holding, it is necessary to cool again and to coil in a temperature range of 600° C. or less.

On the other hand, in the case where a steel sheet is produced of which hole expandability is considered to be important, it is effective to increase the finishing temperature and to perform rapid cooling to a temperature in a range of the Bs point or less in order to increase hardenability. In particular, it is preferable that the microstructure be more homogeneous and mechanical properties thereof have less anisotropy. Specifically, the finishing temperature is set to be in a range of ($Ar_3$+50° C.) or more; and thereby, the orientation of crystals is arranged with a specific direction during hot rolling. As a result, the development of texture is suppressed. In addition, it is preferable that in order to form a bainite single-phase structure, the coiling temperature of the hot-rolled material be in a range of 300 to 550° C.

In the case where the coiling temperature exceeds 600° C., precipitation of alloy carbonitrides proceeds in the hot-rolled steel sheet. Therefore, the increase in the strength due to precipitate strengthening after annealing is not sufficiently obtained, and fatigue properties are deteriorated. Accordingly, the upper limit of the coiling temperature is set to be 600° C. The lower limit is not particularly provided. As the coiling temperature is lowered, amounts of solid-solubilized Ti, Nb, Mo, and V are increased; and thereby, the increase in the strength due to precipitation strengthening during annealing is enhanced. Therefore, in order to obtain the properties of the present invention, a lower coiling temperature is effective. However, in practice, since the steel sheet is cooled by water cooling, the room temperature becomes the lower limit.

As described above, during the hot rolling stage, the coiling temperature is controlled so as to suppress precipitation of alloy carbonitrides; and thereby, Ti maintains in a solid-solution state while suppressing the amount of formed precipitates as low as possible. In the hot-rolled steel sheet after coiling, it is preferable that ½ or greater of the amount of contained Ti exists in the solid-solution state. In this case, the increase in the strength due to precipitation strengthening after annealing is further enhanced.

Next, the hot-rolled steel sheet is pickled, and then the pickled hot-rolled steel sheet is subjected to first skin pass rolling at an elongation rate in a range of 0.1 to 5.0%.

The reason for limitations of the elongation during the first skin pass rolling after acid pickling is described.

In the present invention, it is an important production condition to perform the first skin pass at an elongation in a range of 0.1 to 5.0%. By subjecting the hot-rolled steel sheet to skin pass, strains are provided in the surface of the steel sheet. During annealing in a subsequent step, nuclei of alloy carbonitrides are more likely to be formed on the dislocation via these strains; and thereby, the surface layer is hardened. In the case where the elongation rate of the skin pass is less than 0.1%, sufficient strains cannot be provided; and as a result, the surface layer hardness Hvs is not increased. On the other hand, in the case where the elongation rate of the skin pass exceeds 5.0%, strains are provided not only in the surface layer but also in the center portion of the steel sheet; and as a result, the workability of the steel sheet is degraded. In a typical steel sheet, ferrite is recrystallized by the subsequent annealing; and thereby, elongation or hole expandability is improved. However, in the case where the component composition of the present invention is included and coiling is performed in a temperature range of 600° C. or less, Ti, Nb, Mo, and V which are solid-solubilized in the hot-rolled steel sheet drastically delay ferrite recrystallization due to annealing; and thereby, elongation and hole expandability after annealing is not improved. Therefore, the upper limit of the elongation rate of the skin pass rolling is set to be 5.0%. Strains are provided in accordance with the elongation rate of the skin pass rolling. In terms of improvement of fatigue properties, precipitation strengthening proceeds in the surface layer and the vicinity thereof in the steel sheet during annealing in accordance with the amount of strains in the surface layer of the steel sheet. Therefore, it is preferable that the elongation rate be in a range of 0.4% or more. In addition, in terms of workability of the steel sheet, in order to prevent deterioration of the workability due to the strains provided in the steel sheet, it is preferable that the elongation rate be in a range of 2.0% or less.

Figure 2:
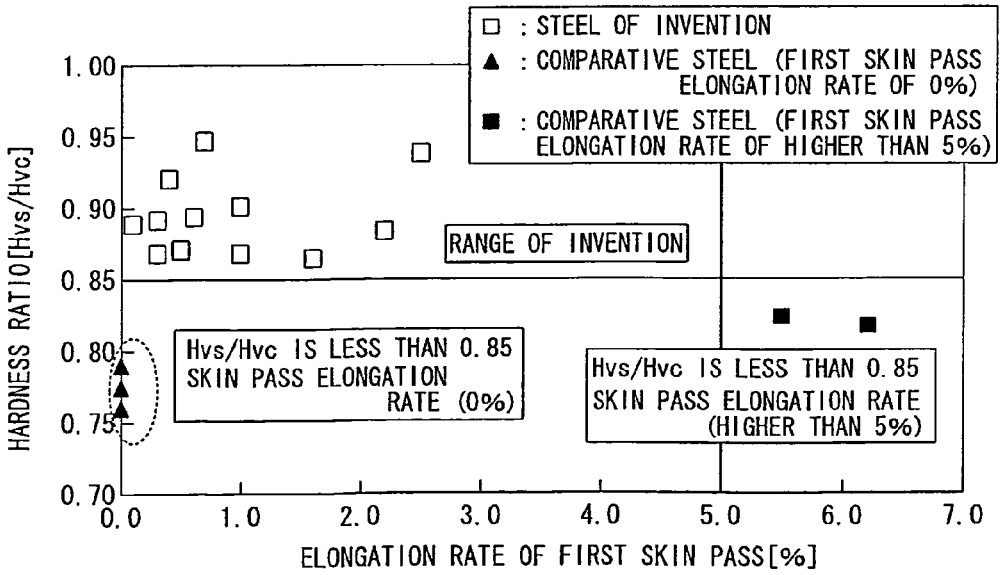
FIG. 2 is a graph showing a relationship between an elongation rate of first skin pass and Hvs/Hvc.

From the results of FIG. 2, it can be identified that in the case where the elongation rate of the skin pass rolling is in a range of 0.1 to 5.0%, Hvs/Hvc is improved to be in a range of 0.85 or more. In addition, it can also be identified that in the case where skin pass is not performed (the elongation rate of the skin pass rolling is 0%), or in the case where the elongation rate of the skin pass rolling exceeds 5%, Hvs/Hvc<0.85 is fulfilled.

Figure 3:
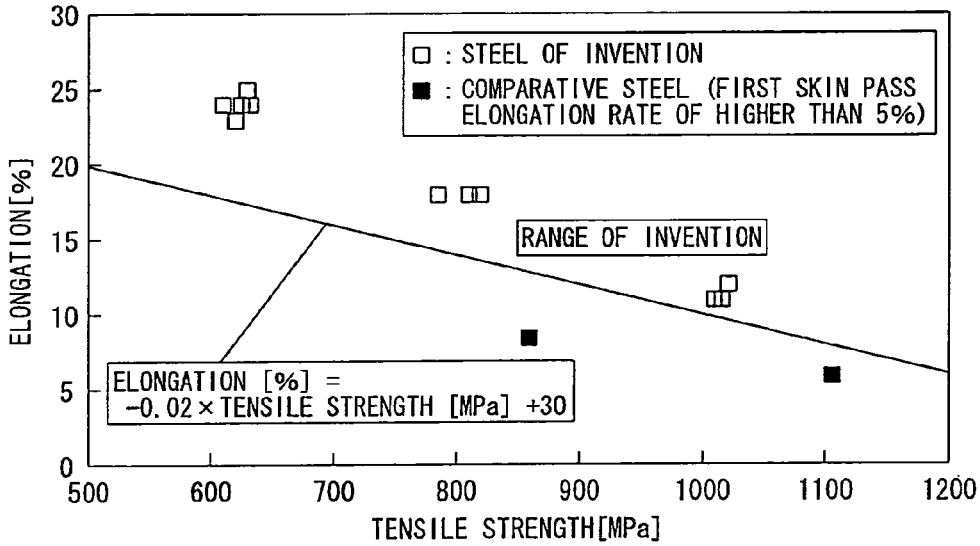
FIG. 3 is a graph showing a relationship between a tensile strength and an elongation.

From the results of FIG. 3, it can be identified that in the case where the elongation rate of the first skin pass is in a range of 0.1 to 5.0%, excellent elongation is obtained. In addition, it can also be identified that in the case where the first skin pass elongation rate exceeds 5.0%, elongation is deteriorated, and press formability is deteriorated. From the results of FIG. 4, it can be identified that in the case where the first skin pass rate is 0% or exceeds 5%, the fatigue strength ratio is deteriorated.

Figure 4:
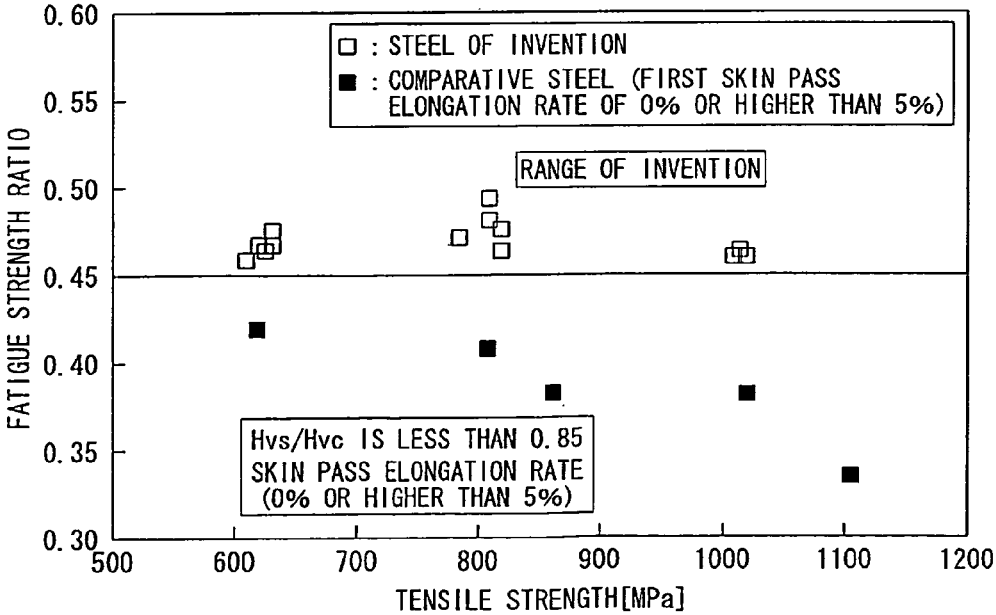
FIG. 4 is a graph showing a relationship between a tensile strength and a fatigue strength ratio.

From the results of FIGS. 3 and 4, it can be identified that in the case where the elongation rate of the skin pass rolling is in a range of 0.1 to 5.0%, substantially the same elongation and fatigue strength ratio are obtained if tensile strengths are substantially the same. It can be identified that in the case where the elongation rate of the skin pass rolling exceeds 5% (high skin pass region), elongation is low and the fatigue strength ratio is also low, compared to those of the steel sheet of the present invention having a tensile strength in the same level.

Next, the hot-rolled steel sheet is annealed after performing the first skin pass rolling. In addition, for the purpose of shape correction, leveling may be used.

In the present invention, the purpose of performing annealing is not to temper the hard phase but to precipitate Ti, Nb, Mo, and V as alloy carbonitrides from Ti, Nb, Mo, and V which are solid-solubilized (dissolved as a solid solution) in the hot-rolled steel sheet. Accordingly, it is important to control a maximum heating temperature (Tmax) and a holding time during the annealing step. The maximum heating temperature and the holding time are controlled to be in predetermined ranges; and thereby, not only the tensile strength and the yield stress are increased, but also the surface layer hardness is enhanced. As a result, the fatigue properties and collision properties are improved. In the case where the temperature and the holding time during annealing are inappropriate, carbonitrides are not precipitated or precipitated carbonitrides coarsen. Therefore, the maximum heating temperature and the holding time are limited as follows.

In the present invention, the maximum heating temperature during annealing is set to be in a range of 600 to 750° C. In the case where the maximum heating temperature is less than 600° C., a time required to precipitate alloy carbonitrides becomes long drastically; and thereby, it becomes difficult to produce the steel sheet in continuous annealing equipment. Therefore, the lower limit thereof is set to be 600° C. In addition, in the case where the maximum heating temperature exceeds 750° C., coarsening of alloy carbonitrides occurs; and thereby, the increase in the strength due to precipitation strengthening is not sufficiently obtained. In addition, in the case where the maximum heating temperature is in a range of an $Ac_1$ point or more, the temperature is in a two-phase region of ferrite and austenite; and thereby, the increase in strength due to the precipitate strengthening is not sufficiently obtained. Therefore, the upper limit thereof is set to be 750° C. The main purpose of the annealing is not to temper the hard phase but to precipitate Ti which is solid-solubilized in the hot-rolled steel sheet. Here, the final strength is determined by alloy components of the steel material and the fraction of each phase in the microstructure of the hot-rolled steel sheet. However, the improvement of the fatigue properties due to the hardening of the surface layer and the enhancement of the yield ratio, which are the characteristics of the present invention, are not influenced by the alloy components of the steel material and the fraction of each phase in the microstructure of the hot-rolled steel sheet.

As a result of the tests, it was found that in the case where a holding time (t) in a temperature range of 600° C. or higher during annealing fulfills a relationship of Expressions (1) and (2) as follows in relation to the maximum heating temperature Tmax during annealing, a high yield stress and Hvs/Hvc in a range of 0.85 or more are attained.

$$530-0.7\times T\max \leq t \leq 3{,}600-3.9\times T\max \quad (1)$$

$$t>0 \quad (2)$$

Figure 5:
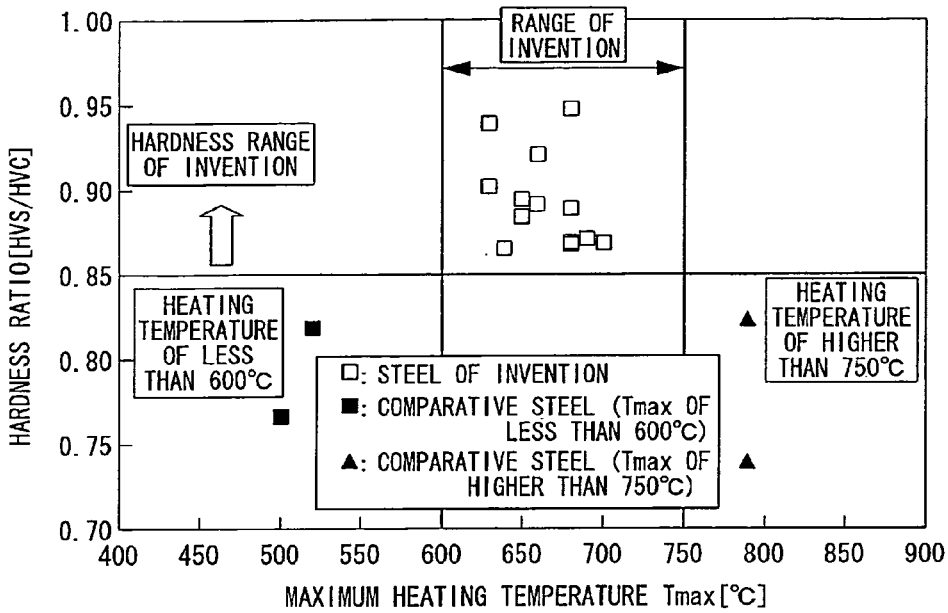
FIG. 5 is a graph showing a relationship between a maximum heating temperature (Tmax) of annealing and Hvs/Hvc.

From the results of FIG. 5, it can be identified that in the case where the maximum heating temperature is in a range of 600 to 750° C., Hvs/Hvc becomes 0.85 or more.

Figure 6:
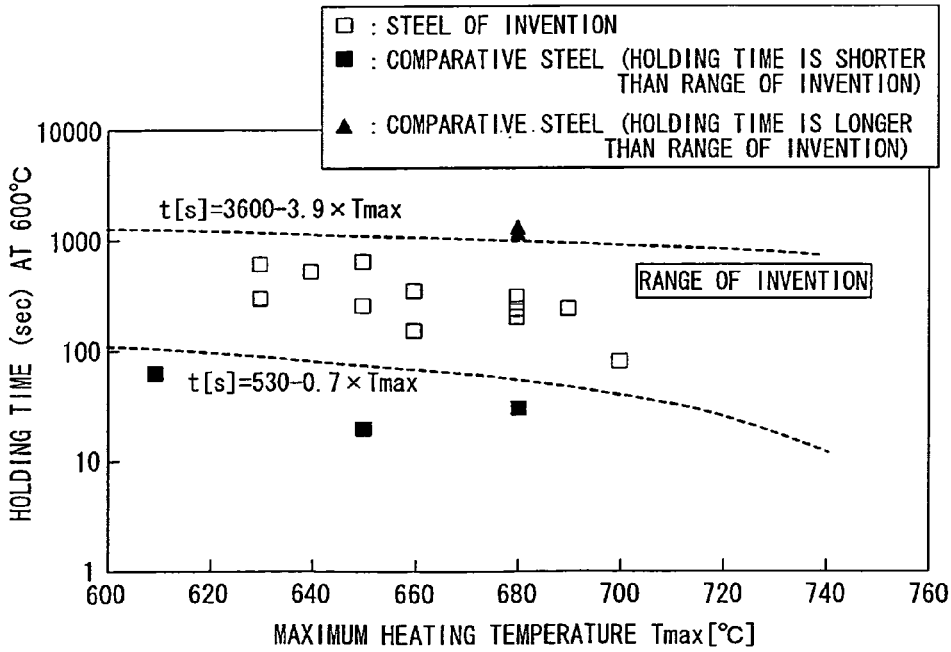
FIG. 6 is a graph showing a relationship between a maximum heating temperature and a holding time in a temperature range of 600° C. or higher during annealing.

Moreover, as shown in FIG. 6, all the steel sheets of the present invention in examples are produced under conditions where the holding time (t) in a temperature range of 600° C. or higher fulfills the ranges of the Expressions (1) and (2). From the evaluation results of the steel sheets of the present invention in the examples, it can be identified that in the case where the holding time (t) fulfills the ranges of Expressions (1) and (2), Hvs/Hvc becomes 0.85 or more.

From the examples, it can be identified that in the case where Hvs/Hvc is in a range of 0.85 or more, the fatigue strength ratio becomes 0.45 or more. In the case where the maximum heating temperature is in a range of 600 to 750° C., the surface layer is hardened due to precipitation strengthening; and thereby, Hvs/Hvc becomes 0.85 or more. By setting the maximum heating temperature and the holding time in a temperature range of 600° C. or higher to be in the above-described ranges, the surface layer is sufficiently hardened compared to the hardness of the center portion of the steel sheet. As a result, as shown in the examples, the fatigue strength ratio becomes 0.45 or more. This is because generation of fatigue cracks can be delayed by the hardening of the surface layer. As the surface layer hardness is increased, the effect is increased.

In addition, from the results of FIG. 5, it can be identified that in the case where the maximum heating temperature is not in the range (out of the range) of 600 to 750° C., Hvs/Hvc<0.85 is fulfilled. In addition, from the examples, it can be identified that even in the case where the maximum heating temperature is in a range of 600 to 750° C., Hvs/Hvc<0.85 is fulfilled if the coiling temperature of the hot-rolled material and the elongation rate of the skin pass are not in the ranges of the present invention.

Thereafter, the annealed hot-rolled steel sheet is subjected to second skin pass rolling. Thereby, the fatigue properties can further be improved.

During the second skin pass rolling, the elongation rate is preferably set to be in a range of 0.2 to 2.0%, and the elongation rate is more preferably in a range of 0.5 to 1.0%. In the case where the elongation rate is less than 0.2%, a surface roughness is not improved sufficiently and work hardening of only the surface layer is not proceeded. As a result, there may be cases where fatigue properties are not sufficiently improved. Therefore, it is preferable that the lower limit thereof is set to be 0.2%. On the other hand, in the case where the elongation rate exceeds 2.0%, the steel sheet is hardened too much; and as a result, there may be cases where press formability is deteriorated. In addition, for example, among examples described later, in Experimental Example L-a, since the elongation rate of the second skin pass rolling after annealing is 2.5%, the elongation becomes 17% which is inferior to those of other Experimental Examples. There may be cases where the elongation is degraded as is the case with Experimental Example L-a. Therefore, it is preferable that the upper limit be 2.0%.

The component composition containing alloying elements and production conditions are controlled precisely in the above-described manner; and thereby, a high-strength steel sheet can be produced which has excellent fatigue properties and collision safety that cannot be achieved in the prior art and has a tensile strength in a range of 590 MPa or more.

The method for manufacturing the hot-dipped steel sheet of the present invention includes: a step of producing a hot-rolled steel sheet as is the case with the above-described method for manufacturing the high-strength steel sheet of the present invention; a step of acid-pickling the hot-rolled steel sheet; a step of subjecting the hot-rolled steel sheet to first skin pass rolling at an elongation rate in a range of 0.1 to 5.0%; a step of annealing the hot-rolled steel sheet under conditions where a maximum heating temperature (Tmax° C.) is in a range of 600 to 750° C. and a holding time (t seconds) in a temperature range of 600° C. or higher fulfills the Expressions (1) and (2), and performing hot dipping to form a hot-dipped layer on a surface of the hot-rolled steel sheet, thereby obtaining a hot-dipped steel sheet; and a step of subjecting the hot-dipped steel sheet to second skin pass rolling.

The step until the hot-rolled steel sheet is obtained, the step of acid-pickling, the step of performing the first skin pass rolling, and the annealing are performed under the same conditions as those of the above-described method for manufacturing the high-strength steel sheet of the present invention.

The conditions of the hot dipping are not particularly limited, and a well-known technique is applied. As a kind of plating elements, for example, either one or both of zinc and aluminum may be employed.

Figure 7:
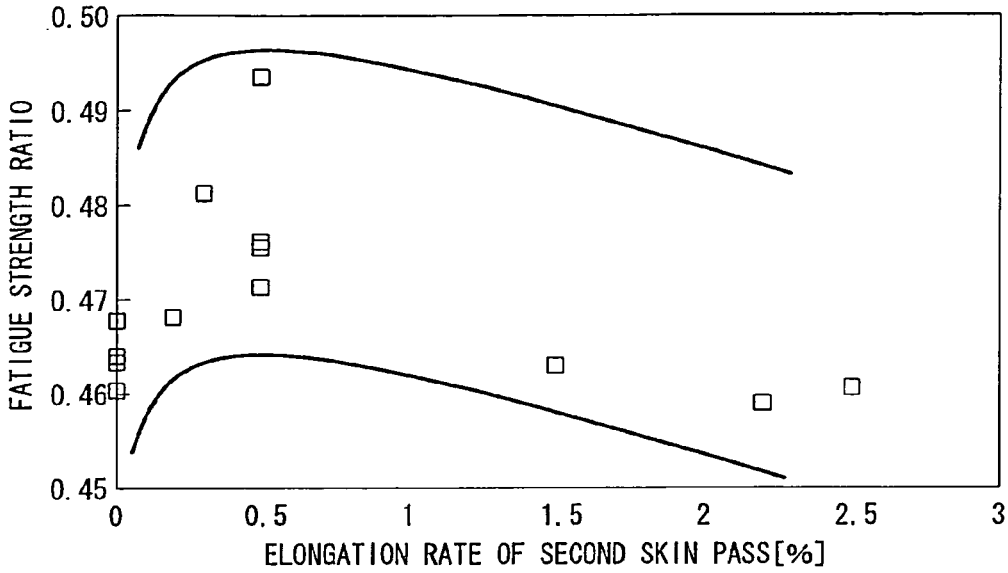
FIG. 7 is a graph showing a relationship between an elongation rate (rolling rate) of a second skin pass after annealing and a fatigue strength ratio.

During the second skin pass rolling, the elongation rate is preferably set to be in a range of 0.2 to 2.0%, and the elongation rate is more preferably in a range of 0.5 to 1.0%. Thereby, as shown in FIG. 7, the fatigue strength is further improved, and the fatigue strength ratio can further be improved. It is thought that this is because the surface layer is further hardened by the work hardening of the surface layer of the steel sheet due to the skin pass rolling. In the case where the elongation rate is less than 0.2%, there may be cases where sufficient work hardening is not obtained. Therefore, it is preferable that the lower limit thereof is set to be 0.2%. In the case where the elongation rate exceeds 2.0%, there may be cases where the improvement of the fatigue strength ratio is not confirmed, and furthermore, there may also be cases where the elongation is degraded. Therefore, it is preferable that the lower limit be 2.0%.

The method for manufacturing an alloyed hot-dipped steel sheet of the present invention includes: a step of producing a hot-rolled steel sheet as is the case with the above-described method for manufacturing the high-strength steel sheet of the present invention; a step of acid-pickling the hot-rolled steel sheet; a step of subjecting the hot-rolled steel sheet to first skin pass rolling at an elongation rate in a range of 0.1 to 5.0%; a step of annealing the hot-rolled steel sheet under conditions where a maximum heating temperature (Tmax° C.) is in a range of 600 to 750° C. and a holding time (t seconds) in a temperature range of 600° C. or higher fulfills the Expressions (1) and (2), performing hot dipping to form a hot-dipped layer on a surface of the hot-rolled steel sheet, thereby obtaining a hot-dipped steel sheet, and subjecting the hot-dipped steel sheet to an alloying treatment to convert the hot-dipped layer into an alloyed hot-dipped layer; and a step of subjecting the hot-dipped steel sheet on which the alloying treatment is performed to second skin pass rolling.

The step until the hot-rolled steel sheet is obtained, the step of acid-pickling, the step of performing the first skin pass rolling, and the annealing are performed under the same conditions as those of the above-described method for manufacturing the high-strength steel sheet of the present invention. In addition, the step of performing hot dipping is performed under the same conditions as those of the above-described method for manufacturing the hot-dipped steel sheet of the present invention.

The conditions of the alloying treatment are not particularly limited, and a well-known technique is applied.

During the second skin pass rolling, the elongation rate is preferably set to be in a range of 0.2 to 2.0%, and the elongation rate is more preferably in a range of 0.5 to 1.0%. Thereby, the fatigue strength ratio can further be improved. In the case where the elongation rate is less than 0.2%, there may be cases where sufficient work hardening is not obtained. Therefore, it is preferable that the lower limit thereof is 0.2%. In the case where the elongation rate exceeds 2.0%, there may be cases where the improvement of the fatigue strength ratio is not confirmed, and furthermore, there may also be cases where the elongation is degraded. Therefore, it is preferable that the lower limit be 2.0%.

EXAMPLES

Hereinafter, examples of the present invention are described.

Using steel materials (slabs) Nos. A to Z shown in Table 1, steel sheets were produced under the condition shown in Tables 2 to 8. Here, $Ar_3$ in Table 1 is a value calculated by Expression (3) as follows. The compositional ratios (the content of each element) are all represented by mass %, and underlined values represent out of the range of the present invention.

$$Ar_3=910-310\times C-80\times Mn-80\times Mo+33\times Si+40\times Al \quad (3)$$

Here, element symbols in Expression (3) represent the contents (mass %) of the elements.

TABLE 1

| Steel No. | C | Si | Mn | P | S | Al | N | Ti | Nb | Mo | V | Ca | Mg | B | Ar3 | Note |
|---|---|---|---|---|---|---|---|---|---|---|---|---|---|---|---|---|
| A | 0.04 | 0.04 | 1.34 | 0.0103 | 0.0045 | 0.04 | 0.0036 | 0.069 | — | — | — | — | — | — | 791 | Steel of Invention |
| B | 0.06 | 0.18 | 1.95 | 0.0076 | 0.0040 | 0.03 | 0.0044 | 0.085 | 0.030 | — | — | — | — | — | 731 | Steel of Invention |
| C | 0.08 | 0.65 | 2.30 | 0.0082 | 0.0035 | 0.03 | 0.0038 | 0.135 | 0.025 | — | — | — | — | — | 681 | Steel of Invention |
| D | 0.06 | 0.52 | 2.06 | 0.0096 | 0.0062 | 0.03 | 0.0051 | 0.112 | 0.040 | — | 0.005 | — | 0.0016 | — | 711 | Steel of Invention |
| E | 0.09 | 1.00 | 2.05 | 0.0085 | 0.0039 | 0.03 | 0.0035 | 0.065 | — | 0.150 | — | — | — | — | 674 | Steel of Invention |
| F | 0.05 | 0.03 | 1.65 | 0.0095 | 0.0042 | 0.62 | 0.0038 | 0.068 | — | — | 0.030 | — | — | 0.0012 | 786 | Steel of Invention |
| G | 0.07 | 0.52 | 1.68 | 0.0085 | 0.0055 | 0.03 | 0.0034 | 0.078 | 0.044 | — | — | 0.0013 | — | — | 738 | Steel of Invention |
| H | 0.08 | 0.46 | 1.23 | 0.0073 | 0.0067 | 0.04 | 0.0035 | 0.063 | — | — | — | — | — | — | 773 | Steel of Invention |
| I | 0.07 | 0.13 | 1.85 | 0.0055 | 0.0035 | 0.03 | 0.0045 | 0.072 | 0.090 | — | — | — | — | — | 737 | Steel of Invention |
| J | 0.06 | 0.18 | 1.75 | 0.0082 | 0.0044 | 0.04 | 0.0035 | 0.092 | 0.075 | — | — | — | — | 0.0015 | 747 | Steel of Invention |
| K | 0.07 | 0.15 | 2.01 | 0.0079 | 0.0066 | 0.04 | 0.0035 | 0.102 | 0.036 | 0.003 | — | 0.0015 | — | — | 724 | Steel of Invention |
| L | 0.08 | 1.06 | 2.45 | 0.0085 | 0.0056 | 0.02 | 0.0038 | 0.142 | 0.031 | — | 0.003 | 0.0011 | — | 0.0013 | 655 | Steel of Invention |
| M | 0.02 | 0.02 | 1.81 | 0.0081 | 0.0034 | 0.03 | 0.0042 | 0.065 | — | — | — | — | — | — | 761 | Comparative Steel |
| N | 0.15 | 0.53 | 2.30 | 0.0091 | 0.0035 | 0.02 | 0.0049 | 0.080 | — | — | — | 0.0010 | — | — | 698 | Comparative Steel |
| O | 0.06 | 1.65 | 1.25 | 0.0053 | 0.0041 | 0.03 | 0.0034 | 0.075 | 0.021 | 0.003 | 0.012 | — | — | — | 847 | Comparative Steel |
| P | 0.08 | 0.03 | 0.72 | 0.0054 | 0.0045 | 0.03 | 0.0029 | 0.072 | 0.053 | — | 0.051 | — | — | — | 830 | Comparative Steel |
| Q | 0.06 | 0.03 | 2.70 | 0.0068 | 0.0038 | 0.02 | 0.0038 | 0.065 | 0.041 | 0.032 | 0.058 | — | 0.0022 | — | 675 | Comparative Steel |
| R | 0.09 | 0.04 | 0.95 | 0.0081 | 0.0052 | 1.72 | 0.0039 | 0.075 | 0.051 | 0.021 | 0.064 | — | — | — | 875 | Comparative Steel |
| S | 0.06 | 0.15 | 1.68 | 0.0102 | 0.0053 | 0.30 | 0.0034 | 0.042 | — | — | — | — | — | — | 773 | Comparative Steel |
| T | 0.09 | 0.52 | 2.44 | 0.0072 | 0.0059 | 0.14 | 0.0051 | 0.186 | — | — | 0.002 | — | — | 0.0016 | 725 | Comparative Steel |

hot rolling, coiling, acid pickling, first skin pass rolling, annealing, and second skin pass were performed in this order; and thereby, high-strength steel sheets were produced. All the sheet thicknesses of hot-rolled materials after the hot rolling were set to be 3.0 mm. The rate of temperature increase during the annealing was set to be 5° C./s, and the rate of cooling from the maximum heating temperature was set to be 5° C./s.

In addition, for several Experimental Examples, galvanization and an alloying treatment were performed after the annealing to produce hot-dip galvanized steel sheets and alloyed hot-dip galvanized steel sheets. Here, in the case where the hot-dip galvanized steel sheets were produced, second skin pass was performed after the hot-dip galvanization, and in the case where the alloyed hot-dip galvanized steel sheets were produced, second skin pass was performed after the alloying treatment.

TABLE 2

| | | Hot rolling | | | | First skin pass | Annealing | | | |
|---|---|---|---|---|---|---|---|---|---|---|
| Experimental Example | Steel No. | Heating temperature (° C.) | Finishing temperature (° C.) | Cooling rate (° C./s) | Coiling temperature (° C.) | Elongation rate (%) | Maximum heating temperature (° C.) | Holding time (sec) | Left side of Expression (1) (° C.) | Right side of Expression (1) (° C.) |
| A-a | A | 1230 | 910 | 25 | 515 | 0.8 | 650 | 240 | 75 | 1065 |
| A-b | | 1235 | 915 | 50 | 510 | 1.5 | 720 | 120 | 26 | 792 |
| B-a | B | 1220 | 905 | 45 | 520 | 0.5 | 680 | 240 | 54 | 948 |
| B-b | | 1220 | 920 | 45 | 530 | 0.5 | 700 | 60 | 40 | 870 |
| C-a | C | 1220 | 895 | 40 | 510 | 0.5 | 690 | 240 | 47 | 909 |
| C-b | | 1220 | 890 | 40 | 425 | 0.3 | 700 | 80 | 40 | 870 |
| D-a | D | 1225 | 900 | 35 | 520 | 0.5 | 660 | 120 | 68 | 1026 |
| D-b | | 1220 | 895 | 35 | 525 | 0.5 | 680 | 320 | 54 | 948 |
| E-a | E | 1210 | 905 | 50 | 515 | 0.5 | 660 | 300 | 68 | 1026 |
| E-b | | 1210 | 910 | 50 | 530 | 0.5 | 660 | 95 | 68 | 1026 |
| F-a | F | 1220 | 895 | 40 | 525 | 0.5 | 660 | 300 | 68 | 1026 |
| F-b | | 1220 | 895 | 45 | 510 | 0.5 | 670 | 75 | 61 | 987 |
| G-a | G | 1230 | 920 | 45 | 500 | 0.5 | 680 | 120 | 54 | 948 |
| G-b | | 1225 | 920 | 20 | 530 | 1.5 | 720 | 200 | 26 | 792 |
| H-a | H | 1220 | 920 | 45 | 520 | 0.8 | 630 | 480 | 89 | 1143 |
| H-b | | 1200 | 880 | 40 | 530 | 2.5 | 680 | 260 | 54 | 948 |
| I-a | I | 1220 | 930 | 45 | 510 | 0.8 | 700 | 240 | 40 | 870 |
| I-b | | 1225 | 920 | 50 | 520 | 0.5 | 710 | 120 | 33 | 831 |
| J-a | J | 1225 | 890 | 45 | 480 | 0.8 | 710 | 680 | 33 | 831 |
| J-b | | 1220 | 910 | 45 | 480 | 0.8 | 650 | 240 | 75 | 1065 |

TABLE 3

| Experimental Example | Steel No. | Hot rolling: Heating temperature (° C.) | Hot rolling: Finishing temperature (° C.) | Hot rolling: Cooling rate (° C./s) | Hot rolling: Coiling temperature (° C.) | First skin pass: Elongation rate (%) | Annealing: Maximum heating temperature (° C.) | Annealing: Holding time (sec) | Annealing: Left side of Expression (1) (° C.) | Annealing: Right side of Expression (1) (° C.) |
|---|---|---|---|---|---|---|---|---|---|---|
| K-a | K | 1200 | 900 | 50 | 500 | 0.8 | 690 | 80 | 47 | 909 |
| K-b | | 1230 | 910 | 35 | 450 | 0.8 | 680 | 600 | 54 | 948 |
| L-a | L | 1220 | 920 | 40 | 550 | 0.5 | 710 | 180 | 33 | 831 |
| L-b | | 1225 | 890 | 45 | 500 | 0.8 | 690 | 600 | 47 | 909 |
| M-a | M | 1215 | 900 | 40 | 510 | 0.8 | 650 | 120 | 75 | 1065 |
| M-b | | 1210 | 910 | 45 | 520 | 0.8 | 680 | 120 | 54 | 948 |
| N-a | N | 1205 | 910 | 40 | 140 | 0.5 | 680 | 400 | 54 | 948 |
| N-b | | 1200 | 920 | 40 | 510 | 0.8 | 680 | 890 | 54 | 948 |
| O-a | O | 1210 | 905 | 45 | 450 | 0.5 | 680 | 100 | 54 | 948 |
| O-b | | 1210 | 915 | 45 | 500 | 0.5 | 700 | 600 | 40 | 870 |
| P-a | P | 1230 | 915 | 45 | 450 | 0.5 | 680 | 240 | 54 | 948 |
| P-b | | 1230 | 915 | 45 | 480 | 0.5 | 650 | 600 | 75 | 1065 |
| Q-a | Q | 1210 | 890 | 50 | 480 | 0.8 | 710 | 200 | 33 | 831 |
| Q-b | | 1210 | 895 | 40 | 490 | 0.8 | 700 | 260 | 40 | 870 |
| R-a | R | 1225 | 905 | 40 | 550 | 0.5 | 650 | 200 | 75 | 1065 |
| R-b | | 1225 | 920 | 45 | 500 | 0.5 | 680 | 200 | 54 | 948 |
| S-a | S | 1210 | 910 | 40 | 550 | 0.4 | 670 | 240 | 61 | 987 |
| S-b | | 1210 | 905 | 40 | 520 | 0.4 | 670 | 120 | 61 | 987 |
| T-a | T | 1220 | 910 | 40 | 480 | 0.5 | 710 | 240 | 33 | 831 |
| T-b | | 1220 | 910 | 50 | 490 | 0.6 | 700 | 200 | 40 | 870 |

TABLE 4

| Experimental Example | Second skin pass Elongation rate (%) | Plating step | Note |
|---|---|---|---|
| A-a | 0.2 | Without plating | Steel of Invention |
| A-b | 0.4 | Alloyed hot-dip galvanization | Steel of Invention |
| B-a | 0.3 | Without plating | Steel of Invention |
| B-b | 0.5 | Alloyed hot-dip galvanization | Steel of Invention |
| C-a | 0.3 | Without plating | Steel of Invention |
| C-b | 0.5 | Hot-dip galvanization | Steel of Invention |
| D-a | 1.5 | Hot-dip galvanization | Steel of Invention |
| D-b | 0.3 | Alloyed hot-dip galvanization | Steel of Invention |
| E-a | 0.3 | Hot-dip galvanization | Steel of Invention |
| E-b | 0.5 | Alloyed hot-dip galvanization | Steel of Invention |
| F-a | 0.4 | Hot-dip galvanization | Steel of Invention |
| F-b | 0.4 | Alloyed hot-dip galvanization | Steel of Invention |
| G-a | 0.3 | Hot-dip galvanization | Steel of Invention |
| G-b | 0.3 | Alloyed hot-dip galvanization | Steel of Invention |
| H-a | 0.3 | Hot-dip galvanization | Steel of Invention |
| H-b | 0.3 | Alloyed hot-dip galvanization | Steel of Invention |
| I-a | 0.3 | Without plating | Steel of Invention |
| I-b | 4.5 | Alloyed hot-dip galvanization | Steel of Invention |
| J-a | 1.8 | Without plating | Steel of Invention |
| J-b | 0.3 | Alloyed hot-dip galvanization | Steel of Invention |

TABLE 5

| Experimental Example | Second skin pass Elongation rate (%) | Plating step | Note |
|---|---|---|---|
| K-a | 0.3 | Without plating | Steel of Invention |
| K-b | 0.4 | Alloyed hot-dip galvanization | Steel of Invention |

TABLE 5-continued

| Experimental Example | Second skin pass Elongation rate (%) | Plating step | Note |
|---|---|---|---|
| L-a | 2.5 | Without plating | Steel of Invention |
| L-b | 0.3 | Alloyed hot-dip galvanization | Steel of Invention |
| M-a | 0.3 | Without plating | Comparative Steel |
| M-b | 0.3 | Alloyed hot-dip galvanization | Comparative Steel |
| N-a | 0.3 | Without plating | Comparative Steel |
| N-b | 0.4 | Alloyed hot-dip galvanization | Comparative Steel |
| O-a | 0.3 | Without plating | Comparative Steel |
| O-b | 0.3 | Alloyed hot-dip galvanization | Comparative Steel |
| P-a | 0.5 | Hot-dip galvanization | Comparative Steel |
| P-b | 0.4 | Alloyed hot-dip galvanization | Comparative Steel |
| Q-a | 0.3 | Hot-dip galvanization | Comparative Steel |
| Q-b | 0.3 | Alloyed hot-dip galvanization | Comparative Steel |
| R-a | 0.3 | Without plating | Comparative Steel |
| R-b | 0.3 | Alloyed hot-dip galvanization | Comparative Steel |
| S-a | 0.4 | Without plating | Comparative Steel |
| S-b | 0.3 | Alloyed hot-dip galvanization | Comparative Steel |
| T-a | 0.3 | Without plating | Comparative Steel |
| T-b | 0.4 | Alloyed hot-dip galvanization | Comparative Steel |

TABLE 6

| Experimental Example | Steel No. | Hot rolling: Heating temperature (° C.) | Hot rolling: Finishing temperature (° C.) | Hot rolling: Cooling rate (° C./s) | Hot rolling: Coiling temperature (° C.) | First skin pass Elongation rate (%) | Annealing: Maximum heating temperature (° C.) | Annealing: Holding time (sec) | Left side of Expression (1) (° C.) | Right side of Expression (1) (° C.) |
|---|---|---|---|---|---|---|---|---|---|---|
| A-c | A | 1100 | 900 | 40 | 450 | 0.2 | 660 | 240 | 68 | 1026 |
| A-d | | 1200 | 890 | 35 | 460 | 0.1 | 680 | 200 | 54 | 948 |
| A-e | | 1210 | 910 | 40 | 500 | 0.6 | 650 | 250 | 75 | 1065 |
| A-f | | 1230 | 900 | 30 | 510 | 0.3 | 790 | 200 | −23 | 519 |
| A-g | | 1220 | 910 | 35 | 550 | 0.5 | 650 | 20 | 75 | 1065 |
| A-h | | 1230 | 900 | 30 | 580 | 1.0 | 680 | 1210 | 54 | 948 |
| A-i | | 1220 | 890 | 35 | 680 | 0.3 | 650 | 300 | 75 | 1065 |
| A-j | | 1210 | 890 | 35 | 630 | 0.3 | 680 | 100 | 54 | 948 |
| A-k | | 1220 | 900 | 40 | 550 | 0.0 | 720 | 40 | 26 | 792 |
| A-l | | 1200 | 910 | 40 | 560 | 0.4 | 660 | 150 | 68 | 1026 |
| A-m | | 1190 | 870 | 45 | 230 | 0.7 | 680 | 300 | 54 | 948 |
| A-n | | 1210 | 760 | 45 | 560 | 0.6 | 710 | 320 | 33 | 831 |
| A-o | | 1210 | 900 | 40 | 470 | 0.3 | 660 | 320 | 68 | 1026 |
| B-c | B | 1200 | 905 | 45 | 570 | 0.5 | 680 | 240 | 54 | 948 |
| B-d | | 1210 | 920 | 45 | 650 | 0.5 | 700 | 60 | 40 | 870 |
| B-e | | 1220 | 910 | 30 | 500 | 0.8 | 520 | 600 | 166 | 1572 |
| B-f | | 1230 | 900 | 35 | 510 | 2.5 | 630 | 600 | 89 | 1143 |

TABLE 7

| Experiment Example | Steel No. | Hot rolling: Heating temperature (° C.) | Hot rolling: Finishing temperature (° C.) | Hot rolling: Cooling rate (° C./s) | Hot rolling: Coiling temperature (° C.) | First skin pass Elongation rate (%) | Annealing: Maximum heating temperature (° C.) | Annealing: Holding time (sec) | Left side of Expression (1) (° C.) | Right side of Expression (1) (° C.) |
|---|---|---|---|---|---|---|---|---|---|---|
| B-g | B | 1210 | 890 | 35 | 530 | 2.1 | 680 | 1100 | 54 | 948 |
| B-h | | 1220 | 920 | 40 | 550 | 4.3 | 610 | 60 | 103 | 1221 |
| B-i | | 1230 | 930 | 45 | 580 | 6.2 | 680 | 200 | 54 | 948 |
| B-j | | 1200 | 910 | 30 | 520 | 2.2 | 650 | 630 | 75 | 1065 |
| B-k | | 1210 | 915 | 45 | 530 | 1.0 | 630 | 300 | 89 | 1143 |
| B-l | | 1210 | 920 | 45 | 200 | 0.0 | 680 | 150 | 54 | 948 |
| B-m | | 1200 | 910 | 30 | 515 | 0.6 | 790 | 300 | −23 | 519 |
| B-n | | 1210 | 915 | 30 | 530 | 0.5 | 680 | 30 | 54 | 948 |
| B-o | | 1220 | 900 | 30 | 550 | 1.6 | 640 | 510 | 82 | 1104 |
| C-c | C | 1200 | 895 | 45 | 530 | 0.5 | 690 | 240 | 47 | 909 |
| C-d | | 1210 | 890 | 40 | 430 | 0.3 | 700 | 80 | 40 | 870 |
| C-e | | 1230 | 905 | 40 | 490 | 1.0 | 680 | 310 | 54 | 948 |
| C-f | | 1210 | 910 | 45 | 670 | 1.5 | 650 | 500 | 75 | 1065 |
| C-g | | 1210 | 915 | 30 | 350 | 0.0 | 630 | 800 | 89 | 1143 |
| C-h | | 1220 | 920 | 35 | 515 | 5.5 | 660 | 300 | 68 | 1026 |
| C-i | | 1210 | 890 | 35 | 530 | 2.1 | 500 | 300 | 180 | 1650 |

TABLE 8

| Experimental Example | Second skin pass Elongation rate (%) | Plating step | Note |
|---|---|---|---|
| A-c | 0.2 | Without plating | Comparative Steel |
| A-d | 0 | Alloyed hot-dip galvanization | Steel of Invention |
| A-e | 0.5 | Hot-dip galvanization | Steel of Invention |
| A-f | 0.1 | Alloyed hot-dip galvanization | Comparative Steel |
| A-g | 0.5 | Alloyed hot-dip galvanization | Comparative Steel |
| A-h | 0.3 | Alloyed hot-dip galvanization | Comparative Steel |
| A-i | 1 | Hot-dip galvanization | Comparative Steel |
| A-j | 1 | Hot-dip galvanization | Comparative Steel |
| A-k | 0.6 | Alloyed hot-dip galvanization | Comparative Steel |
| A-l | 2.2 | Alloyed hot-dip galvanization | Steel of Invention |
| A-m | 0 | Without plating | Steel of Invention |
| A-n | 0.6 | Without plating | Comparative Steel |
| A-o | 0.2 | Hot-dip galvanization | Steel of Invention |

TABLE 8-continued

| Experimental Example | Second skin pass Elongation rate (%) | Plating step | Note |
|---|---|---|---|
| B-c | 0.5 | Without plating | Steel of Invention |
| B-d | 0.5 | Alloyed hot-dip galvanization | Comparative Steel |
| B-e | 0.5 | Alloyed hot-dip galvanization | Comparative Steel |
| B-f | 0 | Without plating | Steel of Invention |
| B-g | 0.3 | Hot-dip galvanization | Comparative Steel |
| B-h | 0.5 | Hot-dip galvanization | Comparative Steel |
| B-i | 0.3 | Alloyed hot-dip galvanization | Comparative Steel |
| B-j | 0.5 | Alloyed hot-dip galvanization | Steel of Invention |
| B-k | 0.5 | Alloyed hot-dip galvanization | Steel of Invention |
| B-l | 0.5 | Alloyed hot-dip galvanization | Comparative Steel |
| B-m | 0.5 | Alloyed hot-dip galvanization | Comparative Steel |
| B-n | 0.3 | Without plating | Comparative Steel |
| B-o | 0.3 | Alloyed hot-dip galvanization | Steel of Invention |

TABLE 8-continued

| Experimental Example | Second skin pass Elongation rate (%) | Plating step | Note |
|---|---|---|---|
| C-c | 2.5 | Without plating | Steel of Invention |
| C-d | 0 | Hot-dip galvanization | Steel of Invention |
| C-e | 1.5 | Alloyed hot-dip galvanization | Steel of Invention |
| C-f | 0.5 | Alloyed hot-dip galvanization | Comparative Steel |
| C-g | 0.5 | Alloyed hot-dip galvanization | Comparative Steel |
| C-h | 0.8 | Alloyed hot-dip galvanization | Comparative Steel |
| C-i | 1 | Alloyed hot-dip galvanization | Comparative Steel |

In Experimental Examples of Tables 2 to 5, the steel sheets were produced for the purpose of clarifying the criticalities of the ranges of the component contents of the steel sheets of the present invention. Therefore, the production conditions were set to be in the ranges of the present invention. On the other hand, in Experimental Examples of Tables 6 to 8, the steel sheets were produced for the purpose of clarifying the criticalities of the ranges of the production conditions of the present invention. Therefore, slabs Nos. A to C were used of which the component contents were in the ranges of the present invention.

The properties of the produced steel sheets were evaluated by the following methods.

(Microstructure)

In accordance with the method described in the embodiment, samples were taken from the portion which was ¼ of the sheet thickness (at a depth of ¼ of the sheet thickness) inner from the surface of the steel sheet, and then the microstructures thereof were observed. Thereafter, the microstructures were identified, and the area ratio of each structure was measured by an image analysis method.

The density of Ti(C,N) precipitates and the dislocation density were measured by the methods described in the embodiment.

(Tensile Test)

A No. 5 test specimen described in JIS-Z2201 was produced, and a tensile test was performed in accordance with a test method described in JIS-Z2241. Thereby, the tensile strength (TS), yield strength (yield stress), and elongation of the steel sheet were measured.

The acceptance range of the elongation depending on the strength level of the tensile strength was determined by Expression (4) as follows, and the elongation was evaluated. Specifically, the acceptance range of the elongation was determined in a range of equal to or higher than the value of the right side of Expression (4) as follows in consideration of a balance with the tensile strength.

$$\text{Elongation [\%]} \geq 30 - 0.02 \times \text{Tensile Strength [MPa]} \quad (4)$$

(Hardness)

Using MVK-E micro Vickers hardness tester manufactured by Akashi Corporation, the hardness of a cross-section of the steel sheet was measured. As the hardness (Hvs) of the surface layer of the steel sheet, a hardness at a portion that is 20 μm (at a depth of 20 μm) inner from the surface was measured. In addition, as the hardness (Hvc) of the center portion of the steel sheet, a hardness at a portion that is ¼ of the sheet thickness (at a depth of ¼ of the sheet thickness) inner from the surface of the steel sheet was measured. At each portion, hardness measurement was performed three times, and the average of the measured values (average value of n=3) was determined as the hardness (Hvs and Hvc). Here, the applied load was set to 50 gf.

(Fatigue Strength and Fatigue Strength Ratio)

The fatigue strength was measured using a Schenck type plane bending fatigue testing machine in accordance with JIS-Z2275. The stress load during measurement was set at a speed of reversed stress testing of 30 Hz. In addition, under the above-described conditions, the fatigue strength was measured at a cycle of $10^7$ by the Schenck type plane bending fatigue testing machine. Then, the fatigue strength at the cycle of $10^7$ was divided by the tensile strength measured by the above-described tensile test; and thereby, a fatigue strength ratio was calculated. The acceptance range of the fatigue strength ratio was set to be in a range of 0.45 or more.

(Platability)

Platability was evaluated by presence or absence of generation of non-plated portions and plating adhesion property.

Whether or not there was a portion which was not plated (a non-plated portion) was visually checked after hot dipping. A steel sheet where there was no portion which was not plated was determined as "good (pass)", and a steel sheet where there is a portion which is not plated was determined as "bad (fail)".

In addition, plating adhesion property was evaluated as follows. A specimen taken from the plated steel sheet was subjected to a 60 degrees V bending test, and then the specimens on which a bending test was performed was subjected to a tape test. In the case where a blackening of the tape test was less than 20%, the steel sheet was determined as "good (pass)", and in the case where the blackening of the tape test was 20% or more, the steel sheet was determined as "bad (fail)".

(Chemical Conversion Property)

Using a dip type bond liquid (surface treatment agent) which is commonly used, the surface of the steel sheet was subjected to a chemical conversion treatment; and thereby, a phosphate film was formed. Then, a crystalline state of phosphate was observed by a scanning electron microscope at 10,000-fold magnification with 5 fields of view. In the case where crystals of phosphate were precipitated on the entire surface, the steel sheet was determined as "good (pass)", and in the case where there were portions at which crystals of phosphate were not precipitated was determined as "bad (fail)".

TABLE 9

| | Microstructure | | | | | Mechanical properties | | | | |
|---|---|---|---|---|---|---|---|---|---|---|
| Experimental Example | Ferrite (%) | Bainite (%) | Martensite (%) | Density of Ti(C, N) precipitates (/mm$^3$) | Dislocation density (/m$^2$) | Yield stress (MPa) | Tensile strength (MPa) | Yield ratio | Calculated result of Expression (4) | Elongation (%) |
| A-a | 85 | 15 | — | $2 \times 10^{10}$ | $2 \times 10^{13}$ | 590 | 640 | 0.92 | 17.2 | 28 |
| A-b | 60 | 40 | — | — | $2 \times 10^{13}$ | 570 | 610 | 0.93 | 17.8 | 26 |
| B-a | 30 | 70 | — | $1 \times 10^{11}$ | $4 \times 10^{13}$ | 760 | 820 | 0.93 | 13.6 | 15 |
| B-b | 25 | 75 | — | — | $4 \times 10^{13}$ | 770 | 830 | 0.93 | 13.4 | 14 |
| C-a | 15 | 85 | — | — | $6 \times 10^{13}$ | 915 | 1010 | 0.91 | 9.8 | 11 |

TABLE 9-continued

| Experimental Example | Microstructure: Ferrite (%) | Bainite (%) | Martensite (%) | Density of Ti(C, N) precipitates (/mm$^3$) | Dislocation density (/m$^2$) | Mechanical properties: Yield stress (MPa) | Tensile strength (MPa) | Yield ratio | Calculated result of Expression (4) | Elongation (%) |
|---|---|---|---|---|---|---|---|---|---|---|
| C-b | 5 | 70 | 25 | — | $6 \times 10^{13}$ | 950 | 1020 | 0.93 | 9.6 | 10 |
| D-a | 25 | 75 | — | — | $4 \times 10^{13}$ | 790 | 860 | 0.92 | 12.8 | 13 |
| D-b | 20 | 80 | — | — | $3 \times 10^{13}$ | 770 | 850 | 0.91 | 13 | 14 |
| E-a | 10 | 80 | 10 | — | $8 \times 10^{13}$ | 690 | 840 | 0.82 | 13.2 | 16 |
| E-b | 5 | 70 | 25 | — | $8 \times 10^{13}$ | 680 | 830 | 0.82 | 13.4 | 15 |
| F-a | 40 | 60 | — | — | $5 \times 10^{13}$ | 590 | 625 | 0.94 | 17.5 | 23 |
| F-b | 45 | 55 | — | — | $3 \times 10^{13}$ | 570 | 610 | 0.93 | 17.8 | 22 |
| G-a | 30 | 70 | — | — | $6 \times 10^{13}$ | 770 | 785 | 0.98 | 14.3 | 18 |
| G-b | 35 | 65 | — | — | $4 \times 10^{13}$ | 775 | 790 | 0.98 | 14.2 | 18 |
| H-a | 40 | 60 | — | $3 \times 10^{10}$ | $8 \times 10^{13}$ | 625 | 680 | 0.92 | 16.4 | 18 |
| H-b | 30 | 70 | — | — | $6 \times 10^{13}$ | 610 | 690 | 0.88 | 16.2 | 19 |
| I-a | 10 | 90 | — | — | $4 \times 10^{13}$ | 735 | 855 | 0.86 | 12.9 | 14 |
| I-b | 15 | 85 | — | — | $4 \times 10^{13}$ | 750 | 840 | 0.89 | 13.2 | 15 |
| J-a | 5 | 70 | 25 | — | $4 \times 10^{13}$ | 960 | 995 | 0.96 | 10.1 | 12 |
| J-b | 0 | 60 | 40 | — | $7 \times 10^{13}$ | 940 | 990 | 0.95 | 10.2 | 11 |

TABLE 10

| Experimental Example | Microstructure: Ferrite (%) | Bainite (%) | Martensite (%) | Density of Ti(C, N) precipitates (precipitates/mm$^3$) | Dislocation density (/m$^2$) | Mechanical properties: Yield stress (MPa) | Tensile strength (MPa) | Yield ratio | Calculated result of Expression (4) | Elongation (%) |
|---|---|---|---|---|---|---|---|---|---|---|
| K-a | 30 | 70 | — | $2 \times 10^{11}$ | $6 \times 10^{13}$ | 810 | 850 | 0.95 | 13 | 15 |
| K-b | 30 | 60 | 10 | — | $6 \times 10^{13}$ | 830 | 860 | 0.97 | 12.8 | 14 |
| L-a | 0 | 70 | 30 | — | $6 \times 10^{13}$ | 960 | 1120 | 0.86 | 7.6 | 9 |
| L-b | 0 | 75 | 25 | — | $5 \times 10^{13}$ | 950 | 1090 | 0.87 | 8.2 | 9 |
| M-a | 90 | 10 | — | — | $2 \times 10^{13}$ | 410 | 430 | 0.95 | 21.4 | 25 |
| M-b | 95 | 5 | — | — | $1 \times 10^{13}$ | 420 | 440 | 0.95 | 21.2 | 24 |
| N-a | 0 | 20 | 80 | — | $2 \times 10^{14}$ | 890 | 1170 | 0.76 | 6.6 | 7 |
| N-b | 0 | 10 | 90 | — | $3 \times 10^{14}$ | 900 | 1150 | 0.78 | 7 | 7 |
| O-a | 50 | 50 | — | — | $4 \times 10^{13}$ | 570 | 615 | 0.93 | 17.7 | 19 |
| O-b | 65 | 35 | — | — | $3 \times 10^{13}$ | 560 | 620 | 0.90 | 17.6 | 18 |
| P-a | 90 | 10 | — | — | $5 \times 10^{13}$ | 440 | 470 | 0.94 | 20.6 | 23 |
| P-b | 95 | 5 | — | — | $4 \times 10^{13}$ | 430 | 460 | 0.93 | 20.8 | 22 |
| Q-a | 10 | 80 | 10 | — | $7 \times 10^{13}$ | 880 | 965 | 0.91 | 10.7 | 9 |
| Q-b | 5 | 90 | 5 | — | $8 \times 10^{13}$ | 890 | 970 | 0.92 | 10.6 | 8 |
| R-a | 40 | 60 | — | — | $7 \times 10^{13}$ | 860 | 930 | 0.92 | 11.4 | 12 |
| R-b | 45 | 55 | — | — | $4 \times 10^{13}$ | 870 | 940 | 0.93 | 11.2 | 13 |
| S-a | 30 | 70 | — | $3 \times 10^{8}$ | $2 \times 10^{13}$ | 580 | 740 | 0.78 | 15.2 | 19 |
| S-b | 20 | 80 | — | — | $3 \times 10^{13}$ | 590 | 760 | 0.78 | 14.8 | 18 |
| T-a | 10 | 90 | — | — | $9 \times 10^{13}$ | 920 | 990 | 0.93 | 10.2 | 8 |
| T-b | 5 | 95 | — | — | $9 \times 10^{13}$ | 910 | 980 | 0.93 | 10.4 | 8 |

TABLE 11

| Experimental Example | Mechanical properties: Hardness of surface layer (Hvs) | Hardness of center portion (Hvc) | Hardness ratio (Hvs/Hvc) | Fatigue strength (MPa) | Fatigue strength ratio | Plating: adhesion or Chemical conversion properties | Note |
|---|---|---|---|---|---|---|---|
| A-a | 165 | 190 | 0.87 | 310 | 0.48 | Good | Steel of Invention |
| A-b | 160 | 180 | 0.89 | 300 | 0.49 | Good | Steel of Invention |
| B-a | 240 | 250 | 0.96 | 420 | 0.51 | Good | Steel of Invention |
| B-b | 240 | 260 | 0.92 | 410 | 0.49 | Good | Steel of Invention |
| C-a | 280 | 300 | 0.93 | 460 | 0.46 | Good | Steel of Invention |
| C-b | 290 | 310 | 0.94 | 470 | 0.46 | Good | Steel of Invention |
| D-a | 250 | 270 | 0.93 | 400 | 0.47 | Good | Steel of Invention |

TABLE 11-continued

| Experimental Example | Mechanical properties: Hardness of surface layer (Hvs) | Hardness of center portion (Hvc) | Hardness ratio (Hvs/Hvc) | Fatigue strength (MPa) | Fatigue strength ratio | Plating: adhesion or Chemical conversion properties | Note |
|---|---|---|---|---|---|---|---|
| D-b | 240 | 260 | 0.92 | 390 | 0.46 | Good | Steel of Invention |
| E-a | 220 | 260 | 0.85 | 380 | 0.45 | Good | Steel of Invention |
| E-b | 215 | 250 | 0.86 | 380 | 0.46 | Good | Steel of Invention |
| F-a | 175 | 190 | 0.92 | 320 | 0.51 | Good | Steel of Invention |
| F-b | 170 | 180 | 0.94 | 315 | 0.52 | Good | Steel of Invention |
| G-a | 200 | 230 | 0.87 | 370 | 0.47 | Good | Steel of Invention |
| G-b | 210 | 235 | 0.89 | 390 | 0.49 | Good | Steel of Invention |
| H-a | 200 | 210 | 0.95 | 350 | 0.51 | Good | Steel of Invention |
| H-b | 195 | 215 | 0.91 | 340 | 0.49 | Good | Steel of Invention |
| I-a | 215 | 240 | 0.90 | 400 | 0.47 | Good | Steel of Invention |
| I-b | 220 | 255 | 0.86 | 390 | 0.46 | Good | Steel of Invention |
| J-a | 280 | 300 | 0.93 | 490 | 0.49 | Good | Steel of Invention |
| J-b | 270 | 290 | 0.93 | 480 | 0.48 | Good | Steel of Invention |

TABLE 12

| Experimental Example | Mechanical properties: Hardness of surface layer (Hvs) | Hardness of center portion (Hvc) | Hardness ratio (Hvs/Hvc) | Fatigue strength (MPa) | Fatigue strength ratio | Plating: adhesion or Chemical conversion properties | Note | |
|---|---|---|---|---|---|---|---|---|
| K-a | 260 | 270 | 0.96 | 410 | 0.48 | Good | | Steel of Invention |
| K-b | 240 | 260 | 0.92 | 420 | 0.49 | Good | | Steel of Invention |
| L-a | 310 | 340 | 0.91 | 510 | 0.46 | Good | | Steel of Invention |
| L-b | 290 | 330 | 0.88 | 520 | 0.48 | Good | | Steel of Invention |
| M-a | 125 | 130 | 0.96 | 205 | 0.48 | Good | Insufficient in TS | Comparative Steel |
| M-b | 135 | 140 | 0.96 | 200 | 0.45 | Good | Insufficient in TS | Comparative Steel |
| N-a | 260 | 350 | 0.74 | 440 | 0.38 | Good | Insufficient in yield ratio, hardness ratio, and fatigue strength ratio | Comparative Steel |
| N-b | 270 | 340 | 0.79 | 460 | 0.40 | Good | Insufficient in yield ratio, hardness ratio, and fatigue strength ratio | Comparative Steel |
| O-a | 180 | 190 | 0.95 | 300 | 0.49 | Bad | Deteriorated chemical conversion properties | Comparative Steel |
| O-b | 190 | 200 | 0.95 | 310 | 0.50 | Bad | Deteriorated platability | Comparative Steel |
| P-a | 130 | 140 | 0.93 | 230 | 0.49 | Good | Insufficient in TS | Comparative Steel |
| P-b | 140 | 150 | 0.93 | 210 | 0.46 | Good | Insufficient in TS | Comparative Steel |
| Q-a | 270 | 300 | 0.90 | 440 | 0.46 | Good | Insufficient in elongation | Comparative Steel |
| Q-b | 260 | 290 | 0.90 | 450 | 0.46 | Good | Insufficient in elongation | Comparative Steel |
| R-a | 275 | 285 | 0.96 | 430 | 0.46 | Bad | Deteriorated chemical conversion properties | Comparative Steel |
| R-b | 285 | 290 | 0.98 | 450 | 0.48 | Bad | Deteriorated platability | Comparative Steel |
| S-a | 175 | 230 | 0.76 | 290 | 0.39 | Good | Insufficient in yield ratio, hardness ratio, and fatigue strength ratio | Comparative Steel |
| S-b | 170 | 220 | 0.77 | 280 | 0.37 | Good | Insufficient in yield ratio, hardness ratio, and fatigue strength ratio | Comparative Steel |
| T-a | 290 | 300 | 0.97 | 480 | 0.48 | Good | Insufficient in elongation | Comparative Steel |
| T-b | 280 | 290 | 0.97 | 470 | 0.48 | Good | Insufficient in elongation | Comparative Steel |

TABLE 13

| Experimental Example | Microstructure: Ferrite (%) | Bainite (%) | Martensite (%) | Density of Ti(C, N) precipitates (precipitates/mm$^3$) | Dislocation density (/m$^2$) | Mechanical properties: Yield stress (MPa) | Tensile strength (MPa) | Yield ratio | Calculated result of Expression (4) | Elongation (%) |
|---|---|---|---|---|---|---|---|---|---|---|
| A-c | 75 | 25 | — | — | $2 \times 10^{13}$ | 400 | 520 | 0.77 | 19.6 | 26 |
| A-d | 75 | 25 | — | — | $2 \times 10^{13}$ | 570 | 620 | 0.92 | 17.6 | 23 |
| A-e | 85 | 15 | — | $2 \times 10^{11}$ | $3 \times 10^{13}$ | 580 | 630 | 0.92 | 17.4 | 25 |

TABLE 13-continued

| Experimental Example | Microstructure: Ferrite (%) | Bainite (%) | Martensite (%) | Density of Ti(C, N) precipitates (precipitates/mm$^3$) | Dislocation density (/m$^2$) | Mechanical properties: Yield stress (MPa) | Tensile strength (MPa) | Yield ratio | Calculated result of Expression (4) | Elongation (%) |
|---|---|---|---|---|---|---|---|---|---|---|
| A-f | 80 | 20 | — | $5 \times 10^9$ | $1 \times 10^{13}$ | 520 | 560 | 0.93 | 18.8 | 25 |
| A-g | 90 | 10 | — | — | $1 \times 10^{14}$ | 510 | 580 | 0.88 | 18.4 | 25 |
| A-h | 90 | 10 | — | — | $1 \times 10^{13}$ | 510 | 570 | 0.89 | 18.6 | 24 |
| A-i | 98 | 2 | — | — | $2 \times 10^{13}$ | 440 | 530 | 0.83 | 19.4 | 28 |
| A-j | 98 | 2 | — | — | $2 \times 10^{13}$ | 435 | 540 | 0.81 | 19.2 | 27 |
| A-k | 90 | 10 | — | — | $2 \times 10^{13}$ | 560 | 620 | 0.90 | 17.6 | 26 |
| A-l | 90 | 10 | — | — | $3 \times 10^{13}$ | 570 | 610 | 0.93 | 17.8 | 24 |
| A-m | 90 | 10 | — | — | $2 \times 10^{13}$ | 580 | 625 | 0.93 | 17.5 | 24 |
| A-n | 95 | 5 | — | — | $2 \times 10^{13}$ | 500 | 595 | 0.84 | 18.1 | 25 |
| A-o | 80 | 20 | — | — | $3 \times 10^{13}$ | 570 | 630 | 0.90 | 17.4 | 24 |
| B-c | 30 | 70 | — | — | $4 \times 10^{13}$ | 730 | 785 | 0.93 | 14.3 | 18 |
| B-d | 35 | 65 | — | — | $2 \times 10^{13}$ | 690 | 760 | 0.91 | 14.8 | 19 |
| B-e | 40 | 60 | — | $9 \times 10^9$ | $3 \times 10^{14}$ | 700 | 760 | 0.92 | 14.8 | 18 |
| B-f | 30 | 70 | — | — | $4 \times 10^{13}$ | 770 | 820 | 0.94 | 13.6 | 18 |

TABLE 14

| Experimental Example | Microstructure: Ferrite (%) | Bainite (%) | Martensite (%) | Density of Ti(C, N) precipitates (precipitates/mm$^3$) | Dislocation density (/m$^2$) | Mechanical properties: Yield stress (MPa) | Tensile strength (MPa) | Yield ratio | Calculated result of Expression (4) | Elongation (%) |
|---|---|---|---|---|---|---|---|---|---|---|
| B-g | 20 | 80 | — | — | $2 \times 10^{13}$ | 730 | 790 | 0.92 | 14.2 | 19 |
| B-h | 30 | 70 | — | — | $2 \times 10^{14}$ | 720 | 795 | 0.91 | 14.1 | 18 |
| B-i | 30 | 70 | — | — | $6 \times 10^{13}$ | 780 | 860 | 0.91 | 12.8 | 9 |
| B-j | 35 | 65 | — | — | $4 \times 10^{13}$ | 720 | 810 | 0.89 | 13.8 | 18 |
| B-k | 30 | 70 | — | $2 \times 10^{11}$ | $6 \times 10^{13}$ | 730 | 820 | 0.89 | 13.6 | 18 |
| B-l | 30 | 50 | 20 | — | $4 \times 10^{13}$ | 680 | 810 | 0.84 | 13.8 | 19 |
| B-m | 35 | 65 | — | — | $4 \times 10^{13}$ | 600 | 760 | 0.79 | 14.8 | 20 |
| B-n | 25 | 75 | — | — | $2 \times 10^{14}$ | 670 | 780 | 0.86 | 14.4 | 18 |
| B-o | 30 | 70 | — | — | $4 \times 10^{13}$ | 730 | 810 | 0.90 | 13.8 | 18 |
| C-c | 20 | 80 | — | — | $8 \times 10^{13}$ | 915 | 1020 | 0.90 | 9.6 | 12 |
| C-d | 10 | 90 | — | — | $7 \times 10^{13}$ | 930 | 1010 | 0.92 | 9.8 | 11 |
| C-e | 15 | 85 | — | — | $7 \times 10^{13}$ | 920 | 1015 | 0.91 | 9.7 | 11 |
| C-f | 50 | 50 | — | — | $5 \times 10^{13}$ | 760 | 960 | 0.79 | 10.8 | 14 |
| C-g | 5 | 50 | 45 | — | $9 \times 10^{13}$ | 910 | 1020 | 0.89 | 9.6 | 12 |
| C-h | 10 | 90 | — | — | $9 \times 10^{13}$ | 970 | 1105 | 0.88 | 7.9 | 6 |
| C-i | 15 | 85 | — | — | $3 \times 10^{14}$ | 800 | 965 | 0.83 | 10.7 | 13 |

TABLE 15

| Experimental Example | Mechanical properties: Hardness of surface layer (Hvs) | Hardness of center portion (Hvc) | Hardness ratio (Hvs/Hvc) | Fatigue strength (MPa) | Fatigue strength ratio | Plating: adhesion or Chemical conversion properties | Note | |
|---|---|---|---|---|---|---|---|---|
| A-c | 130 | 160 | 0.81 | 230 | 0.44 | Good | Insufficient in TS, yield ratio, hardness ratio, and fatigue strength ratio | Comparative Steel |
| A-d | 160 | 180 | 0.89 | 290 | 0.47 | Good | | Steel of Invention |
| A-e | 170 | 190 | 0.89 | 300 | 0.48 | Good | | Steel of Invention |
| A-f | 140 | 170 | 0.82 | 240 | 0.43 | Good | Insufficient in TS, hardness ratio, and fatigue strength ratio | Comparative Steel |
| A-g | 150 | 180 | 0.83 | 230 | 0.40 | Good | Insufficient in TS, hardness ratio, and fatigue strength ratio | Comparative Steel |

TABLE 15-continued

| Experimental Example | Mechanical properties: Hardness of surface layer (Hvs) | Hardness of center portion (Hvc) | Hardness ratio (Hvs/Hvc) | Fatigue strength (MPa) | Fatigue strength ratio | Plating: adhesion or Chemical conversion properties | Note | |
|---|---|---|---|---|---|---|---|---|
| A-h | 145 | 180 | 0.81 | 235 | 0.41 | Good | Insufficient in TS, hardness ratio, and fatigue strength ratio | Comparative Steel |
| A-i | 135 | 165 | 0.82 | 220 | 0.42 | Good | Insufficient in TS, hardness ratio, and fatigue strength ratio | Comparative Steel |
| A-j | 140 | 170 | 0.82 | 230 | 0.43 | Good | Insufficient in TS, hardness ratio, and fatigue strength ratio | Comparative Steel |
| A-k | 150 | 190 | 0.79 | 260 | 0.42 | Good | Insufficient in hardness ratio and fatigue strength ratio | Comparative Steel |
| A-l | 175 | 190 | 0.92 | 280 | 0.46 | Good | | Steel of Invention |
| A-m | 180 | 190 | 0.95 | 290 | 0.46 | Good | | Steel of Invention |
| A-n | 140 | 180 | 0.78 | 240 | 0.40 | Good | Insufficient in hardness ratio and fatigue strength ratio | Comparative Steel |
| A-o | 165 | 185 | 0.89 | 295 | 0.47 | Good | | Steel of Invention |
| B-c | 200 | 230 | 0.87 | 370 | 0.47 | Good | | Steel of Invention |
| B-d | 180 | 230 | 0.78 | 330 | 0.43 | Good | Insufficient in hardness ratio and fatigue strength ratio | Comparative Steel |
| B-e | 180 | 220 | 0.82 | 330 | 0.43 | Good | Insufficient in hardness ratio and fatigue strength ratio | Comparative Steel |
| B-f | 230 | 245 | 0.94 | 380 | 0.46 | Good | | Steel of Invention |

TABLE 16

| Experimental Example | Mechanical properties: Hardness of surface layer (Hvs) | Hardness of center portion (Hvc) | Hardness ratio (Hvs/Hvc) | Fatigue strength (MPa) | Fatigue strength ratio | Plating: adhesion or Chemical conversion properties | Note | |
|---|---|---|---|---|---|---|---|---|
| B-g | 200 | 240 | 0.83 | 340 | 0.43 | Good | Insufficient in hardness ratio and fatigue strength ratio | Comparative Steel |
| B-h | 190 | 240 | 0.79 | 330 | 0.42 | Good | Insufficient in hardness ratio and fatigue strength ratio | Comparative Steel |
| B-i | 200 | 245 | 0.82 | 330 | 0.38 | Good | Insufficient in elongation, hardness ratio, and fatigue strength ratio | Comparative Steel |
| B-j | 230 | 260 | 0.88 | 400 | 0.49 | Good | | Steel of Invention |
| B-k | 230 | 255 | 0.90 | 390 | 0.48 | Good | | Steel of Invention |
| B-l | 190 | 250 | 0.76 | 330 | 0.41 | Good | Insufficient in hardness ratio and fatigue strength ratio | Comparative Steel |
| B-m | 170 | 230 | 0.74 | 310 | 0.41 | Good | Insufficient in yield ratio, hardness ratio, and fatigue strength ratio | Comparative Steel |
| B-n | 175 | 240 | 0.73 | 320 | 0.41 | Good | Insufficient in hardness ratio and fatigue strength ratio | Comparative Steel |
| B-o | 225 | 260 | 0.87 | 390 | 0.48 | Good | | Steel of Invention |
| C-c | 270 | 310 | 0.87 | 470 | 0.46 | Good | | Steel of Invention |
| C-d | 265 | 305 | 0.87 | 465 | 0.46 | Good | | Steel of Invention |
| C-e | 265 | 305 | 0.87 | 470 | 0.46 | Good | | Steel of Invention |
| C-f | 250 | 300 | 0.83 | 380 | 0.40 | Good | Insufficient in yield ratio, hardness ratio, and fatigue strength ratio | Comparative Steel |
| C -g | 240 | 310 | 0.77 | 390 | 0.38 | Good | Insufficient in hardness ratio and fatigue strength ratio | Comparative Steel |
| C-h | 280 | 340 | 0.82 | 370 | 0.33 | Good | Insufficient in elongation, hardness ratio, and fatigue strength ratio | Comparative Steel |
| C-i | 230 | 300 | 0.77 | 360 | 0.37 | Good | Insufficient in hardness ratio and fatigue strength ratio | Comparative Steel |

At first, the influences of the components of the steel materials are described.

The C amounts of steels Nos. M and N are out of the range of the present invention. The steel sheets (Experimental Examples M-a and M-b) produced using the steel No. M were insufficient in strength. The steel sheets (Experimental Examples N-a and N-b) produced using the steel No. N were insufficient in yield ratio and fatigue strength ratio.

The Si amounts and Al amounts of steels Nos. O and R were greater than the ranges of the present invention. The steel sheets (Experimental Examples O-a, O-b, R-a, and R-b)

produced using the steels Nos. O and R had problems with plating adhesion property and chemical conversion property.

The Mn amounts of steels Nos. P and Q are out of the range of the present invention. The steel sheets (Experimental Examples P-a and P-b) produced using the steel No. P were insufficient in strength. The steel sheets (Experimental Examples Q-a and Q-b) produced using the steel No. Q were insufficient in elongation.

The Ti amounts of steels Nos. S and T are out of the range of the present invention. The steel sheets (Experimental Examples S-a and S-b) produced using the steel No. S were insufficient in yield ratio and fatigue strength ratio. The steel sheets (Experimental Examples T-a and T-b) produced using the steel No. T were insufficient in elongation.

Next, the influences of the production conditions are described.

In Experimental Example A-c, the heating temperature of the slab during hot rolling was insufficient; and thereby, TiC could not be dissolved in austenite. Therefore, the produced steel sheet was insufficient in strength and fatigue strength.

In Experimental Example A-n, the finishing temperature during hot rolling was reduced. Therefore, the produced steel sheet was insufficient in fatigue strength ratio.

In Experimental Examples A-i, A-j, B-d, and C-f, since the coiling temperatures during hot rolling were high, amounts of solid-solubilized Ti (solid-solution Ti) in the hot rolling stage became insufficient. Therefore, the produced steel sheets were insufficient in fatigue strength ratio.

In Experimental Examples A-k, B-l, and C-g, since the elongation rates of the first skin pass rolling after the hot rolling were insufficient, introduction of strains to the surface layers of the steel sheets became insufficient. As a result, the precipitation effect in the surface layer after annealing was not sufficiently obtained. Therefore, the produced steel sheets were insufficient in fatigue strength ratio.

In Experimental Examples B-i and C-h, since the elongation rates of the first skin pass rolling after the hot rolling were excessively high, the influence of the processing strains was increased. Therefore, the produced steel sheets were insufficient in elongation and fatigue strength ratio.

In Experimental Examples A-f and B-m, since the annealing temperatures after the first skin pass rolling were high, precipitates coarsened. Therefore, fatigue strength ratios and densities of precipitates of the produced steel sheets were degraded.

In Experimental Examples B-e and C-i, since the annealing temperatures after the first skin pass rolling were low, precipitation of TiC did not sufficiently proceed. Therefore, the produced steel sheets were insufficient in fatigue strength ratio.

In Experimental Examples A-g, B-h, and B-m, since the holding times in a temperature range of 600° C. or higher during the annealing after the first skin pass rolling were short, precipitation of TiC did not proceed sufficiently. Therefore, the produced steel sheets were insufficient in fatigue strength ratio.

In Experimental Examples A-h and B-g, since the holding times in a temperature range of 600° C. or higher during the annealing after the first skin pass rolling were long, precipitates coarsened. Therefore, the produced steel sheets were insufficient in fatigue strength ratio.

Figure 11:
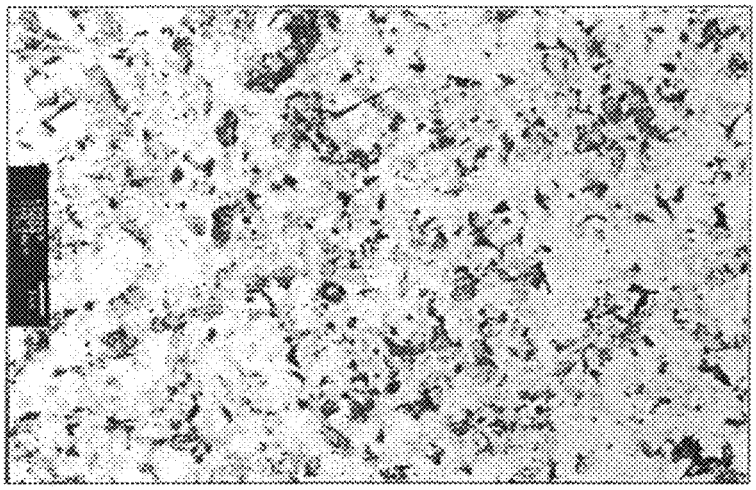
FIG. 11 shows TEM photographs of the microstructure of Experimental Example B-k (steel of the present invention), FIG. 11(*a*) is a photograph at 5,000-fold magnification, FIG. 11(*b*) is a photograph at 100,000-fold magnification, and FIG. 11(*c*) is a photograph at 100,000-fold magnification.
Figure 11:
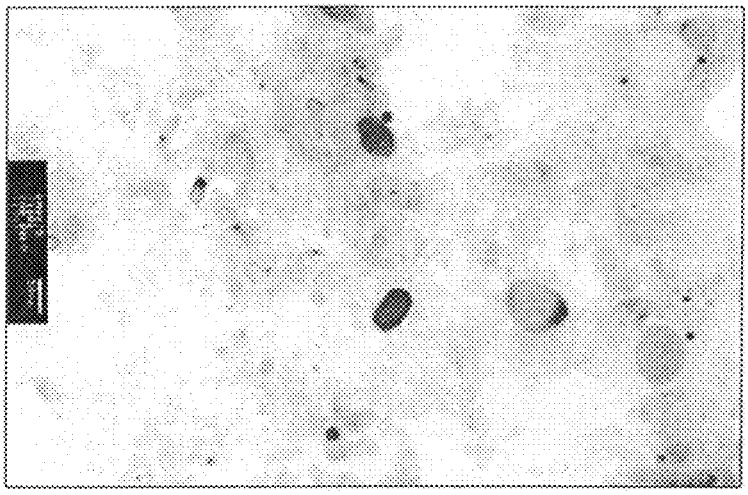
Figure 11:
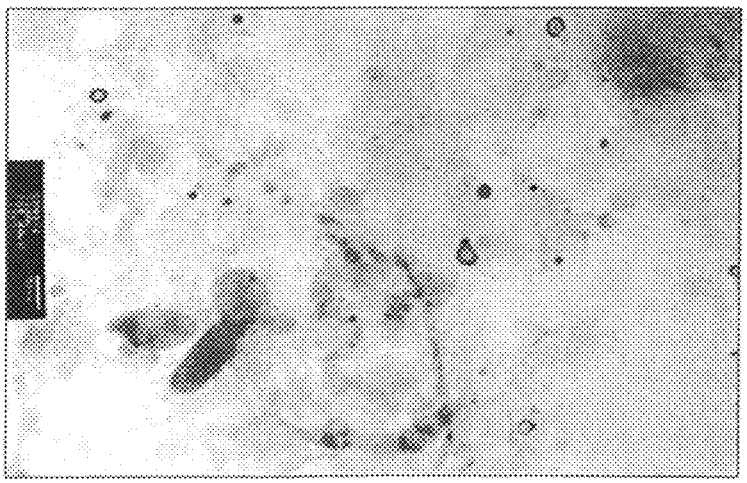
Figure 12:
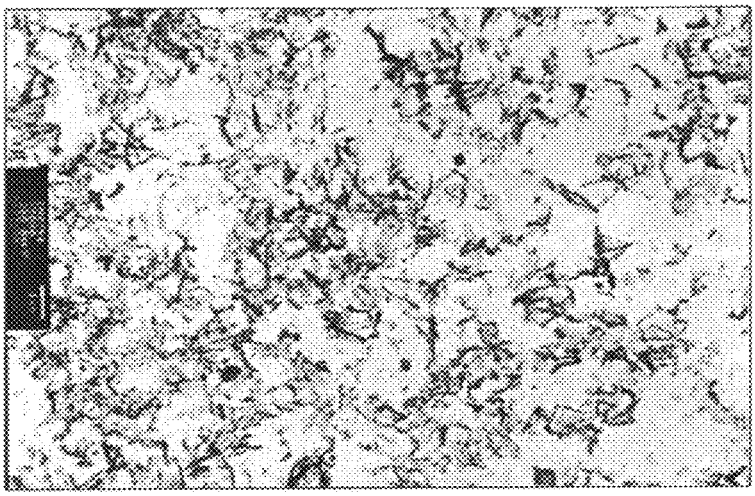
FIG. 12 shows TEM photographs of the microstructure of Experimental Example B-e (comparative steel), FIG. 12(*a*) is a photograph at 5,000-fold magnification, and FIG. 12(*b*) is a photograph at 500,000-fold magnification.
Figure 12:
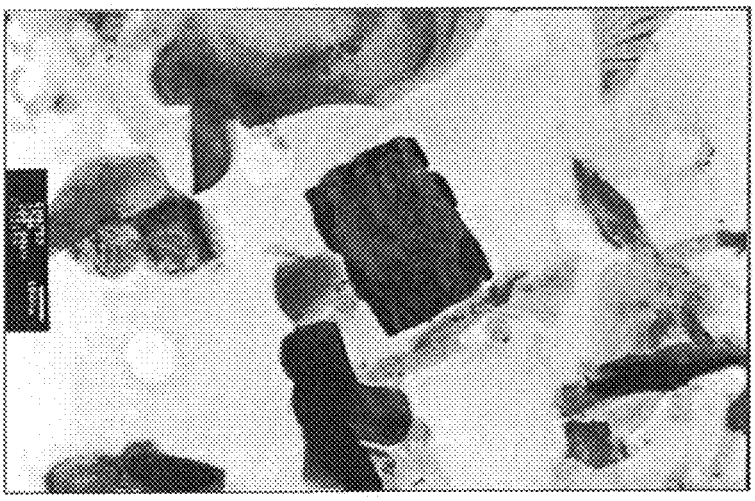
Figure 13:
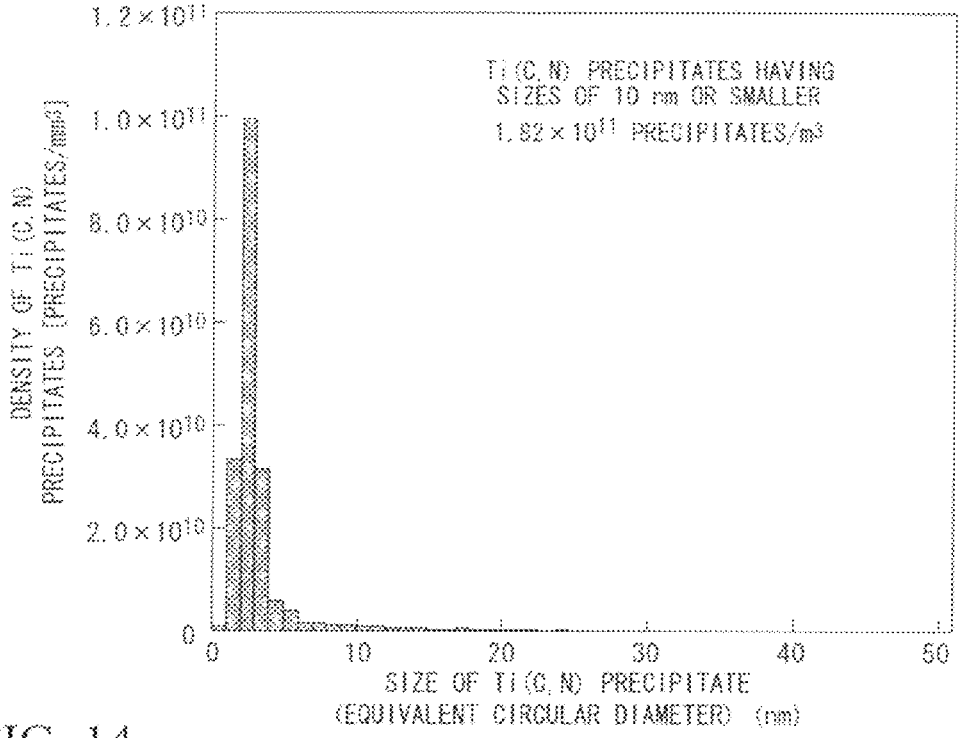
FIG. 13 is a graph showing a size distribution of Ti(C,N) of Experimental Example B-k (steel of the present invention).
Figure 14:
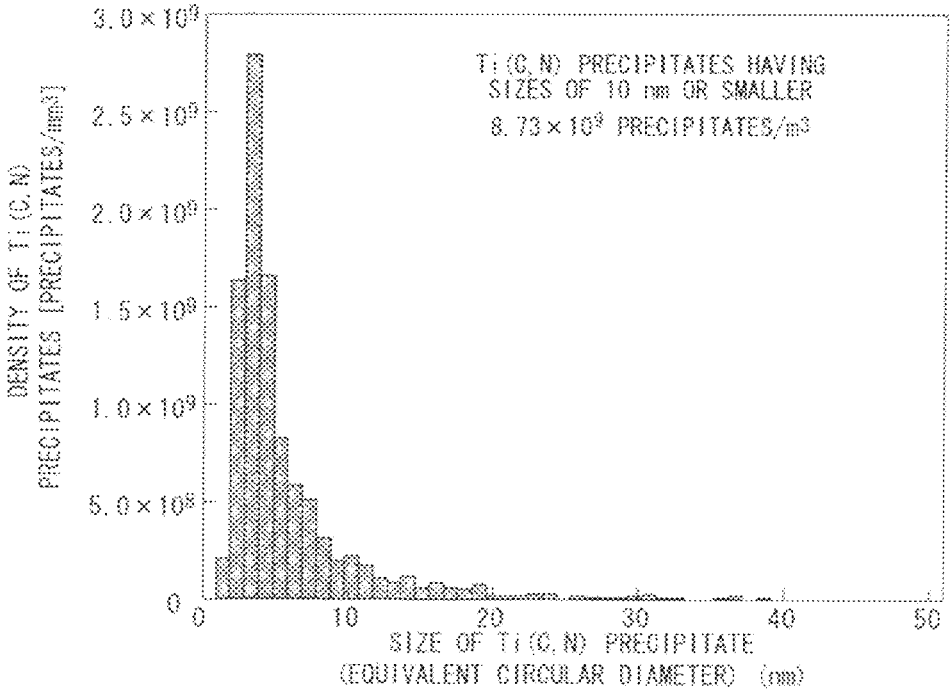
FIG. 14 is a graph showing a size distribution of Ti(C,N) of Experimental Example B-e (comparative steel).

The microstructures of the steel sheet of the present invention (Experimental Example B-k) and the comparative steel (Experimental Example B-e) were compared to each other. In the steel sheet of the present invention (Experimental Example B-k), precipitation of TiC occurred during annealing, and as shown in FIGS. 11 and 13, the density of precipitates having sizes of 10 nm or smaller was increased to $1.82\times10^{11}$ precipitates/mm$^3$. In contrast, in the comparative steel sheet (Experimental Example B-e), precipitation of TiC did not proceed as described above, and as shown in FIGS. 12 and 14, the density of precipitates having sizes of 10 nm or smaller was maintained at about $8.73\times10^9$ precipitates/mm$^3$.

INDUSTRIAL APPLICABILITY

In accordance with the present invention, a high-strength steel sheet, a hot-dipped steel sheet, and an alloyed hot-dipped steel sheet can be provided which have a tensile strength in a range of 590 MPa or more and which are excellent in fatigue properties, elongation and collision properties. In the case where they are applied to components for an automobile, a reduction in the weight and enhancement of safety of the automobile can be achieved. In particular, the hot-dipped steel sheet and the alloyed hot-dipped steel sheet of the present invention have the above-described excellent properties and excellent rust prevention. Therefore, they can be applied to chassis frames, and they can contribute to the reduction in the weight of an automobile. As described above, the present invention can be appropriately applied to fields of steel sheets for automobile components such as chassis frames.

The invention claimed is:

1. A high-strength steel sheet having excellent fatigue properties, elongation and collision properties, comprising: in terms of percent by mass, 0.03 to 0.10% of C;
0.01 to 1.5% of Si;
1.0 to 2.5% of Mn;
0.1% or less of P;
0.02% or less of S;
0.01 to 1.2% of Al;
0.06 to 0.092% of Ti;
0.01% or less of N; and
a balance of iron and inevitable impurities,
wherein
a tensile strength is in a range of 590 MPa or more,
a ratio of a yield strength to the tensile strength is in a range of 0.80 or more,
a microstructure comprises bainite at an area ratio of 40% or more and a balance of at least one of ferrite and martensite,
a density of Ti(C,N) precipitates having sizes of 10 nm or smaller is in a range of $10^{10}$ precipitates/mm$^3$ or more, and
a ratio Hvs/Hvc of a hardness, Hvs, at a depth of 20 μm from a surface to a hardness, Hvc, at a center of a sheet thickness, of 0.92 or more.

2. The high-strength steel sheet according to claim 1, wherein a fatigue strength ratio is in a range of 0.45 or more.

3. The high-strength steel sheet according to claim 1, wherein an average dislocation density is in a range of $1\times10^{14}$ m$^{-2}$ or less.

4. The high-strength steel sheet according to claim 1, wherein the high-strength steel sheet further comprises one or more elements selected from the group consisting of: in terms of percent by mass, 0.005 to 0.1% of Nb;
0.005 to 0.2% of Mo;
0.005 to 0.2% of V;
0.0005 to 0.005% of Ca;
0.0005 to 0.005% of Mg; and
0.0005 to 0.005% of B.

5. A hot-dipped steel sheet having excellent fatigue properties, elongation and collision properties, comprising:

the high-strength steel sheet according to claim 1; and a hot-dipped layer on a surface of the high-strength steel sheet.

6. The hot-dipped steel sheet according to claim 5, wherein the hot-dipped layer consists of Zn.

7. An alloyed hot-dipped steel sheet having excellent fatigue properties, elongation and collision properties, comprising:

the high-strength steel sheet according to claim 1; and an alloyed hot-dipped layer on a surface of the high-strength steel sheet.

8. A method for producing the high-strength steel sheet having excellent fatigue properties, elongation and collision properties according to claim 1, the method comprising:

heating a slab comprising: in terms of percent by mass %, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.092% of Ti; 0.01% or less of N; and a balance of iron and inevitable impurities, at a temperature of 1,150° C. to 1,280° C., hot rolling the heated slab under conditions where a finish rolling is finished at a temperature of not less than an $Ar_3$ point, thereby obtaining a hot-rolled material;

coiling the hot-rolled material at a temperature of 600° C. or less, thereby obtaining a hot-rolled steel sheet;

acid pickling the hot-rolled steel sheet;

subjecting the pickled hot-rolled steel sheet to a first skin pass rolling at an elongation rate of 0.1 to 5.0%;

annealing the hot-rolled steel sheet under conditions where a maximum heating temperature (Tmax° C.) is in a range of 600° C. to 750° C. and a holding time (t seconds) in a temperature range of 600° C. or higher fulfills expressions (1) and (2) as follows; and subjecting the annealed hot-rolled steel sheet to a second skin pass rolling, $$530-0.7\times T\max \le t \le 3{,}600-3.9\times T\max \quad (1)$$

$$t>0 \quad (2).$$

9. The method for producing the high-strength steel sheet according to claim 8, wherein an elongation rate of 0.2 to 2.0% is set in the second skin pass rolling.

10. The method for producing the high-strength steel sheet according to claim 8, wherein ½ or more of the amount of Ti contained in the hot-rolled steel sheet after the coiling exists in a solid-solution state.

11. A method for producing the hot-dipped steel sheet having excellent fatigue properties, elongation and collision properties according to claim 5, the method comprising:

heating a slab comprising: in terms of percent by mass %, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.092% of Ti; 0.01% or less of N; and a balance of iron and inevitable impurities at a temperature of 1,150° C. to 1,280° C.;

hot rolling the heated slab under conditions where a finish rolling is finished at a temperature of not less than an $Ar_3$ point, thereby obtaining a hot-rolled material;

coiling the hot-rolled material at a temperature of 600° C. or less, thereby obtaining a hot-rolled steel sheet;

acid pickling the hot-rolled steel sheet;

subjecting the pickled hot-rolled steel sheet to a first skin pass rolling at an elongation rate of 0.1 to 5.0%;

annealing the hot-rolled steel sheet under conditions where a maximum heating temperature (Tmax° C.) is in a range of 600° C. to 750° C. and a holding time (t seconds) in a temperature range of 600° C. or higher and fulfills expressions (1) and (2) as follows, hot dipping the annealed hot-rolled steel sheet to form a hot-dipped layer on a surface of the hot-rolled steel sheet, thereby obtaining a hot-dipped steel sheet; and subjecting the hot-dipped steel sheet to a second skin pass rolling, $$530-0.7\times T\max \le t \le 3{,}600-3.9\times T\max \quad (1)$$

$$t>0 \quad (2).$$

12. The method for producing the hot-dipped steel sheet according to claim 11, wherein an elongation rate of 0.2 to 2.0% is set in the second skin pass rolling.

13. A method for producing the alloyed hot-dipped steel sheet having excellent fatigue properties, elongation and collision properties according to claim 7, the method comprising:

heating a slab comprising: in terms of percent by mass %, 0.03 to 0.10% of C; 0.01 to 1.5% of Si; 1.0 to 2.5% of Mn; 0.1% or less of P; 0.02% or less of S; 0.01 to 1.2% of Al; 0.06 to 0.092% of Ti; 0.01% or less of N; and a balance of iron and inevitable impurities, at a temperature in a range of 1,150° C. to 1,280° C.;

hot rolling the heated slab under conditions where a finish rolling is finished at a temperature of not less than an $Ar_3$ point, thereby obtaining a hot-rolled material;

coiling the hot-rolled material at a temperature of 600° C. or less, thereby obtaining a hot-rolled steel sheet;

acid pickling the hot-rolled steel sheet;

subjecting the pickled hot-rolled steel sheet to a first skin pass rolling at an elongation rate of 0.1 to 5.0%;

annealing the hot-rolled steel sheet under conditions where a maximum heating temperature (Tmax° C.) is in a range of 600° C. to 750° C. and a holding time (t seconds) in a temperature range of 600° C. or higher and fulfills expressions (1) and (2) as follows, hot dipping the annealed hot-rolled steel sheet to form a hot-dipped layer on a surface of the hot-rolled steel sheet so as to obtain a hot-dipped steel sheet, subjecting the hot-dipped steel sheet to an alloying treatment to convert the hot-dipped layer into an alloyed hot-dipped layer; and subjecting the hot-dipped steel sheet on which the alloying treatment is performed to a second skin pass rolling, $$530-0.7\times T\max \le t \le 3{,}600-3.9\times T\max \quad (1)$$

$$t>0 \quad (2).$$

14. The method for producing the alloyed hot-dipped steel sheet according to claim 13, wherein an elongation rate of 0.2 to 2.0% is set in the second skin pass rolling.

* * * * *